United States Patent [19]

Hobson et al.

[11] 4,058,256

[45] Nov. 15, 1977

[54] WATER CANNON

[75] Inventors: James Charles Hobson, St. Clair Shores; Arthur John Wroble, Grosse Pointe, both of Mich.

[73] Assignee: Cadillac Gage Company, Warren, Mich.

[21] Appl. No.: 733,667

[22] Filed: Oct. 18, 1976

Related U.S. Application Data

[63] Continuation of Ser. No. 582,541, May 30, 1975, abandoned.

[51] Int. Cl.[2] ..... B05B 1/08

[52] U.S. Cl. ..... 239/101; 239/172

[58] Field of Search ..... 89/36 H, 1 A, 40 B, 89/36 K, 36 L; 239/99, 101, 102, 70, 310, 587, 172; 169/24, 25; 251/333

[56] References Cited

U.S. PATENT DOCUMENTS

| | | | |
|---|---|---|---|
| 1,984,531 | 12/1934 | Kind et al. | 239/99 |
| 1,998,592 | 4/1935 | Schenk | 239/99 |
| 2,454,268 | 11/1948 | Brackett | 89/36 K |
| 2,586,236 | 6/1971 | Schaffler | 239/172 |
| 2,752,941 | 7/1956 | Mitchell | 251/333 X |
| 3,568,926 | 3/1971 | Bowles | 239/1 |
| 3,601,987 | 8/1971 | Chermensky et al. | 239/99 X |
| 3,653,596 | 4/1972 | Abrams et al. | 239/101 X |

*Primary Examiner*—John J. Love

*Attorney, Agent, or Firm*—James H. Bower; Mitchell J. Hill

[57] ABSTRACT

A water cannon adapted for controlling large crowds of unruly people in a highly effective, yet non-lethal fashion. The cannon can be mounted on an appropriate vehicle, such as an armored car, so as to make it mobile and its supporting system completely self-contained. The water cannon discharges a high velocity stream of water in a pulsing fashion. Each pulse forms a water projectile which is effective against human targets at ranges up to one hundred feet. The water can be treated with a variety of desired additives. The water cannon includes a cannon body on which is operatively mounted a nozzle for discharging the discrete coherent water projectiles. The discharge of the water projectiles is controlled by a main stage valve, which is in turn controlled by a pilot valve. A water supply reservoir and pump are provided for supplying water under pressure to the main stage valve. An electronic control package emits pulses which in turn, energize a water cannon firing solenoid which controls the pilot valve, so as to cause the cannon to discharge in an "on-off" fashion discharging discrete coherent water projectiles. The pulses emitted are each of a precisely timed duration, approximately 0.3 seconds "on" and from 0.7 to 1.0 second "off" to complete one "on-off" cycle comprising 0.3 to 1.3 seconds duration. The electronic control package ceases emitting pulses after a plurality of shots, as for example three, and the gunner must then reinitiate the firing action.

10 Claims, 13 Drawing Figures

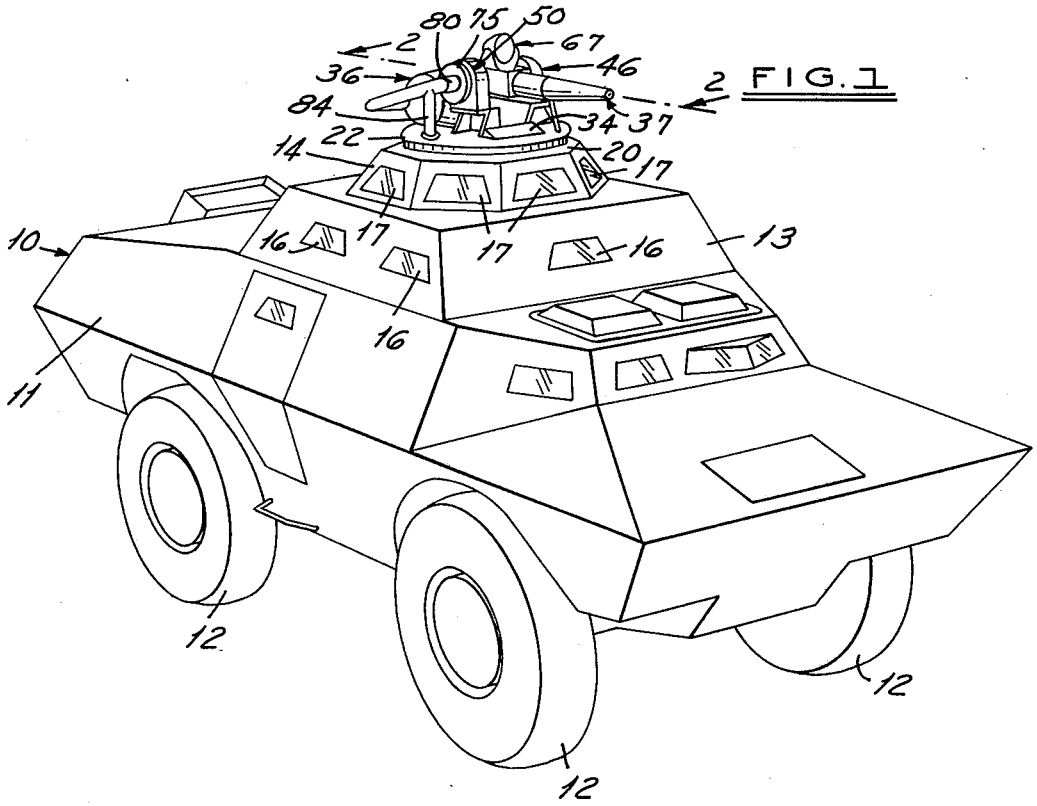
FIG. 1
FIG. 3
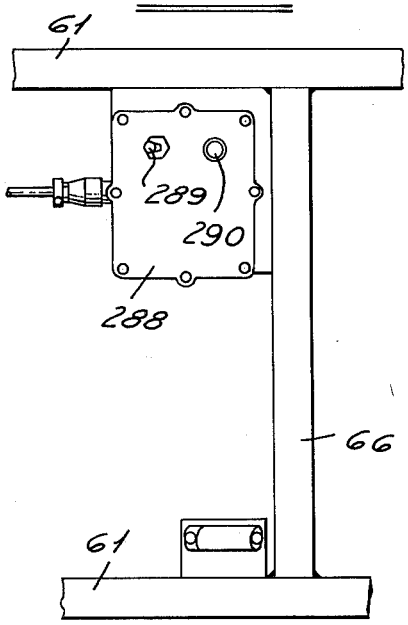

WATER CANNON

This is a continuation, of Ser. No. 582,541, filed May 30, 1975, now abandoned.

SUMMARY OF THE INVENTION

This invention relates to a water cannon apparatus for use in controlling large crowds of unruly people.

The problem of controlling large crowds of unruly people is a law enforcement matter which is handled usually by police and other security forces. The problem of controlling and dispersing large crowds of hostile and unruly people may be generated by a variety of situations as, for example, police raids, political demonstrations, athletic events, picket lines, and so forth. Any of the last mentioned situations can erupt in a violent fashion, and the control of such disorder is a delicate task. A hostile and unruly crowd may resent the use of force by law enforcement personnel, and as a form of retaliation the crowd's conduct may become more violent. In such situations, minor conflicts can escalate into highly destructive riots, whereby martial law is required to stop the loss of life and property. Heretofore, the use of high pressure water emitted from fire hose has been employed in some cases to control large crowds of unruly people. However, a disadvantage of the last mentioned procedure is that the personnel manning the fire hose are not protected from rocks and bottles thrown by a crowd, or from small arms fire by a sniper. A further disadvantage of the use of fire hose for crowd control is that its use is restricted to an area determined by the length of the hose from its source of supply of water under pressure. A further disadvantage of the use of fire hose for crowd control is that the high pressure of the water makes the controlling of the fire hose difficult, so that it is ineffective and inefficient as far as aiming the fire hose nozzle and hitting a desired target is concerned.

In view of the foregoing, it is an important object of the present invention to provide a novel water cannon apparatus which overcomes the aforementioned problems involved in the controlling of large crowds of unruly people, and which overcomes the disadvantages of the prior art means for controlling unruly crowds.

It is another object of the present invention to provide a novel water cannon apparatus for controlling large crowds of unruly people in a highly effective and non-lethal fashion, and which can be used as a stationary apparatus or which can be mounted on an appropriate vehicle, such as an armored car, so as to provide a water cannon apparatus which is highly mobile and completely self-contained.

It is still another object of the present invention to provide a novel water cannon apparatus for discharging a high velocity stream of water in a pulsing fashion, whereby each pulse forms a discrete coherent water projectile or slug of water which is effective against human targets at ranges up to 100 feet. At close ranges, the impact force of the discrete coherent water projectile or slug is sufficient to literally knock a rioter off his feet. The impact force of the water projectile decreases at longer ranges, but the water stream forming such discrete projectile will still severely sting the exposed or lightly covered skin areas of a rioter. The water cannon apparatus of the present invention includes means for treating the water forming the discrete projectile with a variety of additives. These additives include, but are not limited to, identification dyes, skin or eye irritants, foul smelling compounds, and compounds which cause the water forming a discrete coherent water projectile or slug to become very slippery and adherent, thereby increasing the likelihood that a rioter would slip and fall. When fired the cannon repeatedly ejects discrete coherent projectiles of water moving at a high velocity. The volume of water in each projectile is approximately 1 gallon. The coherence of the discrete coherent water projectile is approximately 6 inches in diameter at a range of 100 feet.

It is a further object of the present invention to provide a novel water cannon apparatus which is highly effective for dispersing a hostile crowd without resorting to the use of potentially lethal methods, such as firearms or clubs. The use of the water cannon apparatus in a mobile form on an armored carrier provides a crowd control means that can be operated by a crew which is protected from flying rocks, bottles and other missiles thrown by an unruly crowd, or from small arms fired by a sniper. The water cannon apparatus of the present invention can also provide the auxiliary service of fighting small fires, such as fires started by vandals, and fires which often accompany a major riot. An armored vehicle carrying the water cannon apparatus can be equipped with a public address system, a siren, and with searchlights. The vehicle can also be provided with a radio transmitter and receiver to permit ready communication with its base or other support units. The vehicle also provides protection for the critical vehicle components and components of the water cannon apparatus.

It is another object to provide a water cannon for use in controlling large crowds of unruly people which includes, a cannon body having a discharge nozzle means; a main stage flow control valve means for controlling the discharge of discrete coherent water projectiles or slugs of water in a pulsing fashion from said nozzle means; a pressurized water supply means connected to said cannon body for supplying water under pressure thereto; and, means for controlling said flow control valve means in a pulsing manner to discharge the water cannon in an "on-off" fashion.

It is still another object of the present invention to provide a water cannon for use in controlling large crowds of unruly people which is simple and compact in construction, economical to manufacture, and efficient in operation.

It is still another object of the present invention to provide a water cannon for use in controlling large crowds of unruly people, and which can be used either in a stationary emplacement, or in conjunction with a vehicle, such as an armored vehicle.

It is still another object of the present invention to provide a water cannon for use in controlling large crowds of unruly people which can discharge a plurality of successive discrete coherent water projectiles or slugs of water which contain additives that assist in crowd control and identification purposes.

Other features and advantages of this invention will be apparent from the following detailed description, appended claims, and the accompanying drawings.

BRIEF DESCRIPTION OF THE DRAWINGS

FIG. 1 is a perspective view of an armored vehicle provided with a water cannon apparatus made in accordance with the principles of the present invention.

FIG. 3 is a fragmentary, elevational view of the structure shown in FIG. 2 taken along the line 3—3 thereof, looking in the direction of the arrows, and showing the arm switch for the electronic control system.

DESCRIPTION OF THE PREFERRED EMBODIMENT

Figure 2:
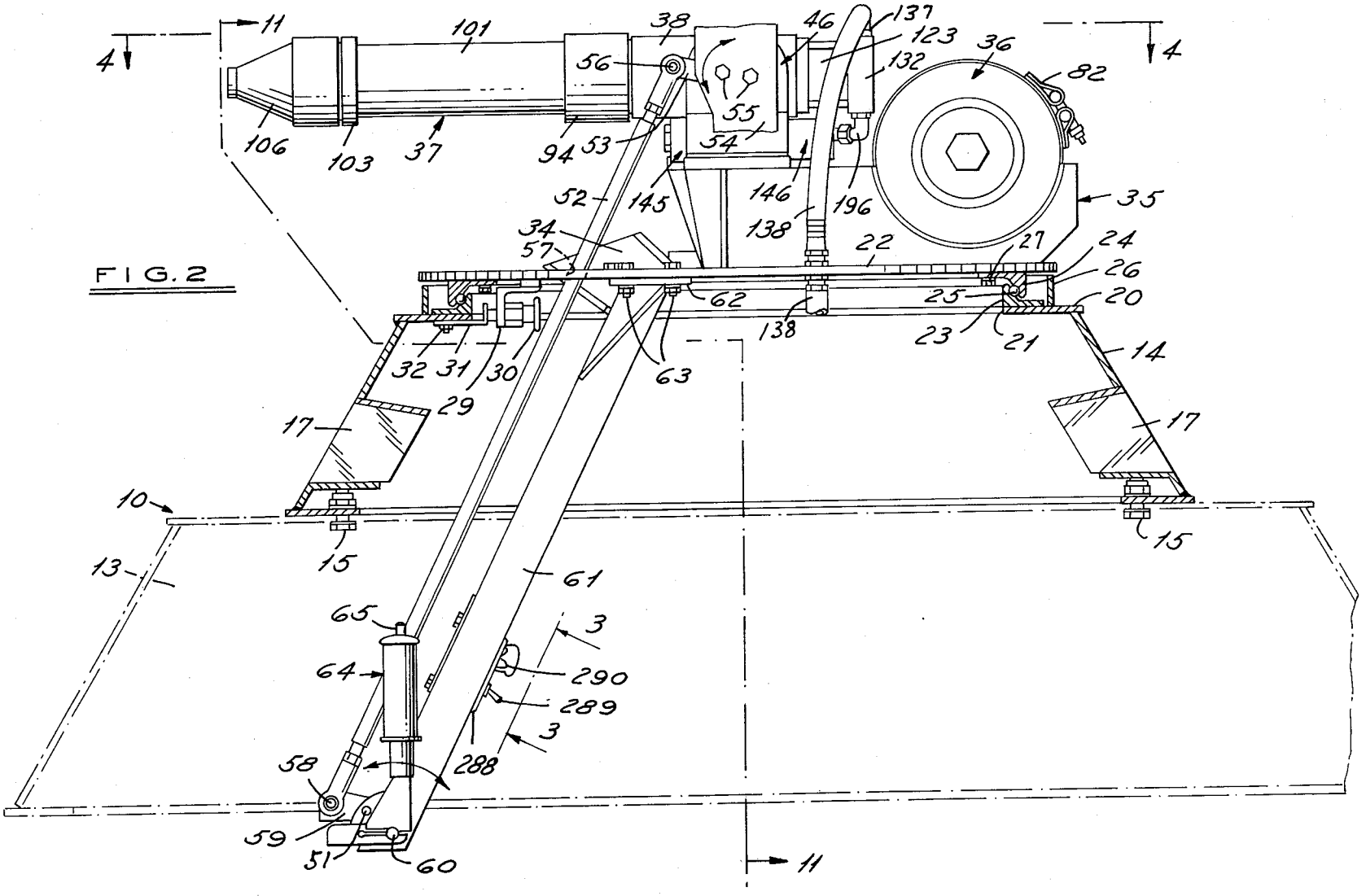
FIG. 2 is a fragmentary, enlarged, elevational view, partly in section, of the water cannon structure shown in FIG. 1, taken substantially along the line 2—2 thereof, and looking in the direction of the arrows.

Referring now to the drawings, and in particular to FIG. 1, the water cannon of the present invention is illustrated in an integrated embodiment with a carrier means, in the form of an armored vehicle generally indicated by the numeral 10. The vehicle 10 illustrates one type of carrier means that may be employed with the water cannon of the present invention. A suitable vehicle 10 with which the water cannon of the present invention may be integrated is one known as "The Commando" which is made and sold by the Cadillac Gage Company of Warren, Michigan. The illustrated "Commando" vehicle 10 includes a body 11 which is supported on four wheels 12, and it is capable of a 55 mile per hour highway speed, with off-road and amphibious capabilities. The armored vehicle 10 provides ballistic protection against small arms fire for all crew members, and for critical vehicle and water cannon components. The integrated water cannon apparatus and vehicle combination illustrated in FIG. 1 may be employed for crowd control duty, and in such cases it can be equipped with a public address system, a siren and search lights. The vehicle 10 may also be provided with a radio transceiver to permit ready communication with its operational base or other support units.

As shown in FIG. 1, the vehicle 10 includes a body top portion 13 on which is fixedly mounted a gunner's cupola 14, which is an armored enclosure. The cupola 14 may be fixed to the vehicle body portion 13 by any suitable means, as by a plurality of machine screw and nut assemblies 15, illustrated in FIG. 2. As shown in FIG. 1, the vehicle body top portion 13 is provided with a plurality of suitable transparent vision blocks 16. The gunner's cupola 14 is circular in plan view, but it is provided with a downwardly and outwardly sloping, annular side wall which carries a plurality of suitable transparent vision blocks 17, to provide the water cannon gunner with 360° visibility. The gunner's cupola 14 includes a fixed roof plate 20 through which is formed a circular opening 21. The roof opening 21 is enclosed by a rotatable circular roof plate 22, which also functions as a support member for the water cannon, generally indicated by the numeral 37.

The roof plate 22 is rotatably mounted on the fixed roof 20 by a suitable circular bearing means which includes a lower circular bearing race 23 and an upper circular bearing race 24, between which is operatively mounted a plurality of suitable ball bearings 25. The lower bearing race 23 is fixed on the roof plate 20 by any suitable means, as by bolts. The upper bearing race 24 is fixed on the lower side of the roof plate 22 by any suitable means, as by a plurality of machine screws 27. The last mentioned bearing means is enclosed by a suitable cylindrical enclosure sleeve 26 which is fixedly mounted on the upper side of the fixed roof plate 20 by any suitable means, as by welding. The enclosure sleeve 26 has its upper end disposed under the rotatable roof plate 22. The roof plate 22 can rotate relative to the cupola 14 to permit the water cannon 37 to be aimed in azimuth.

The rotatable roof plate or support platform 22 may be locked in a fixed position, with the cannon 37 in elevation, for travel purposes. As shown in FIG. 2, a mounting angle bracket 29 is fixed, as by welding, to the underside of the rotatable roof plate 22. Slidably and operably mounted in the vertical leg of the angle bracket 29 is a lock pin 30 which may be pushed forward, or to the left, as viewed in FIG. 2, into a locking engagement in a suitable aperture in an angle bracket 31. The angle bracket 31 is fixed by suitable machine screws 32 to the underside of the fixed roof plate 20.

Figure 4:
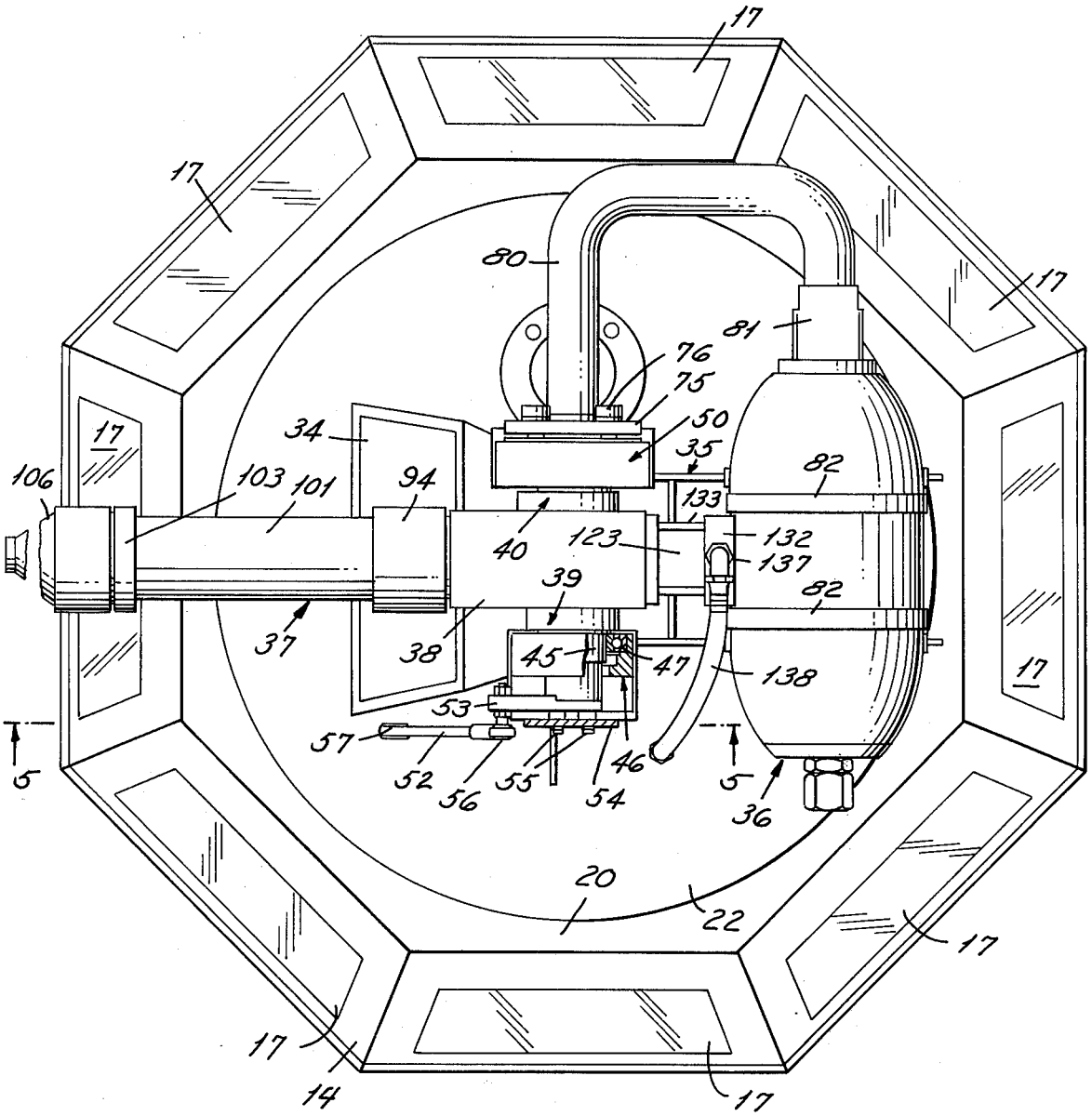
FIG. 4 is a top plan view of the structure shown in FIG. 2, with parts broken away and parts in section, taken along the line 4—4 thereof, and looking in the direction of the arrows.

As shown in FIGS. 2 and 4, the rotatable roof plate or support platform 22 is provided with an additional transparent vision block 34, to permit the water cannon gunner to survey objects above street level, such as roof tops and trees. As illustrated in FIGS. 2 and 4, a water cannon support structure, generally indicated by the numeral 35, is fixed on the top side of the rotatable roof plate 22 by any suitable means, as by welding. The water cannon support structure 35 also supports an accumulator 36, which is described in detail hereinafter.

Figure 5:
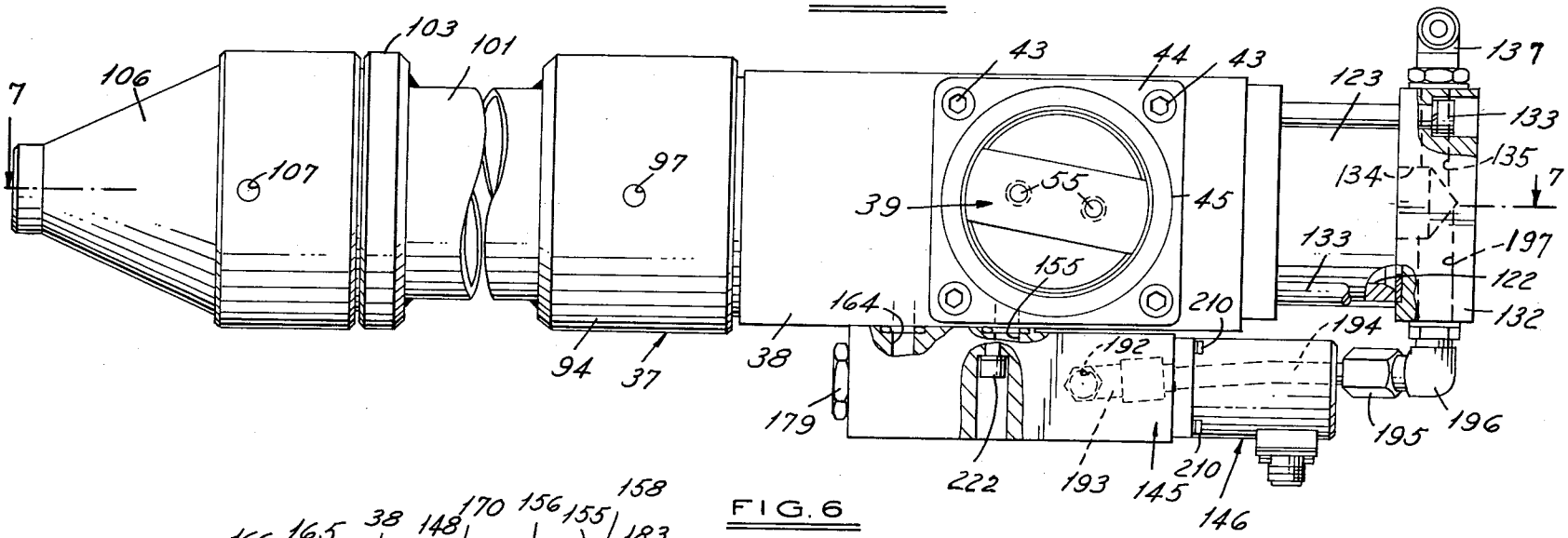
FIG. 5 is an enlarged, broken, side elevational view, with parts in section and parts broken away, of the water cannon apparatus illustrated in FIG. 4, taken along the line 5—5 thereof, and looking in the direction of the arrows.
Figure 7:
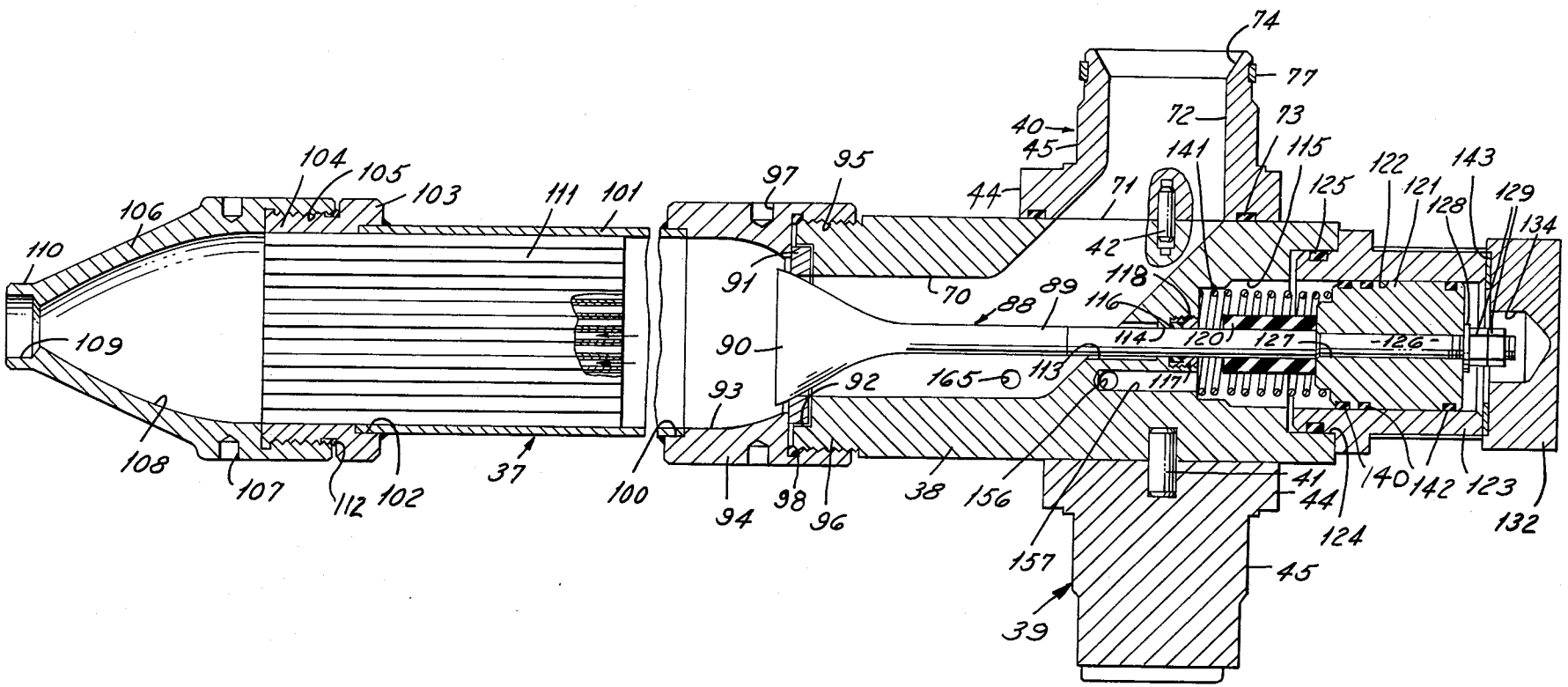
FIG. 7 is a horizontal, broken, section view of the water cannon structure of FIG. 5, taken along the line 7—7 thereof, and looking in the direction of the arrows.

As shown in FIG. 7, the water cannon 37 includes a cylindrical body 38 on which is fixedly mounted a left trunnion, generally indicated by the numeral 39, and a right trunnion, generally indicated by the numeral 40. The trunnions 39 and 40 are retained on the cannon body 38 against lateral movement by the spring pins 41 and 42, respectively. As shown in FIG. 5, the left trunnion 39 is provided with a square mounting flange 44 which is releasably secured to the cannon body 38 by a plurality of suitable socket head screw and lock washer assemblies 43. As shown in FIGS. 4 and 7, the left trunnion 39 is provided with a journal 45 that is rotatably supported by a suitable support bearing means 46 which is provided with a spherical roller bearing means 47. The support bearing means 46 is fixedly mounted by any suitable means on the top side of one of a pair of spaced apart bracket members comprising the supporting structure 35, and as best seen in FIG. 1. The right trunnion 40 is also provided with a similar mounting flange 44 and journal 45, as shown in FIG. 7, and it is similarly mounted in a bearing means 50 carried on the support bracket structure 35. The pivotal mounting of the cannon body 38 on the trunnions 39 and 40 permits the water cannon 37 to be aimed in elevation. The right trunnion 40 is hollow to permit free passage of supply water to the cannon 37, as described in detail hereinafter.

The elevation and azimuth bearing of the water cannon 37 is controlled by the gunner with the following described structure. As shown in FIGS. 2 and 4, a lever 53 has its inner end fixed to the outer end of the left trunnion 39 by a pair of suitable machine screws 55. The machine screws 55 also secure a mounting plate 54 to the left trunnion 39. The mounting plate 54 is adapted to hold any desired accessory, as for example, a search light 67 (FIG. 1) which could be trained in the same direction as the cannon 37 for assistance in night operations. The outer end of the lever 53 is pivotally connected by a suitable pivot shaft 56 to the upper end of an elongated actuating rod 52. The elongated actuating rod 52 extends downwardly through a suitable opening 57 formed through the rotatable roof plate 22 and into the cupola 14 and the vehicle body top portion 13. The lower end of the actuating rod 52 is pivotally attached to the outer end of a lever 59, as shown in FIG. 2, by a suitable pivot shaft 58.

As shown in FIG. 2, the inner end of the lever 59 is fixed by a suitable pin 51 to a control handle 64. The lower end of the control handle 64 is fixed to a transverse pivot shaft 60 which is rotatably supported on the lower ends of a pair of laterally spaced apart carrier arms 61. The carrier arms 61 are fixed together by a cross bracket 66, as illustrated in FIG. 3. Each of the upper ends of the carrier arms 61 is fixed in the same manner to the under side of the rotatable roof plate 22 so as to turn in unison with the roof plate 22. The upper end of one of the carrier arms 61 is shown in FIG. 2 as having a flange 62 on its upper end which is fixedly secured by a pair of suitable machine screw and nut assemblies 63 to the lower side of the rotatable roof plate 22. The other carrier arm 61 would be fixed in the same manner to the rotatable roof plate 22. A second control handle 64 (not shown) is operatively mounted on the other end of the rotatable shaft 60 to provide a pair of control handles, whereby the gunner may operate the cannon 37 with either hand. As shown in FIG. 2, each of the control handles 64 is provided with an individual trigger switch 65. The pair of switches 65 comprise a trigger switch assembly designated generally by the reference numeral 272 in FIG. 12A.

It will be understood that depressing either of the switches 65 initiates the firing of the cannon 37. It will also be seen that tilting the handles 64 forwardly and rearwardly moves the cannon 37 in elevation. The azimuth bearing of the water cannon 37 is effected by pushing sidewardly on the handles 64, to either side, which causes the rotatable roof plate 22 to rotate.

As shown in FIG. 7, the cannon body 38 is provided with an axial valve chamber or cylinder 70 which opens to the front end of the cannon body 38. The rear end of the chamber 70 angles sidewardly and terminates at an inlet port 71. The inlet port 71 communicates with the inner end of a communicating passage 72 formed through the right trunnion 40. The passage 72 terminates at its outer end in a tapered end 74. A suitable preformed packing 73 is mounted in the trunnion 40 around the inlet port 71.

As shown in FIG. 4, one end of a manifold pipe 80 has fixed thereon a flange 75 which is fixed by suitable machine screws 76 to the support bearing means 50. Said one end of the pipe 80 is rotatably seated in the tapered end 74 of the passage 72 to permit rotation of the trunnion 40 relative to the pipe 80. A suitable seal 77 (FIG. 7), such as a spring loaded "Teflon" seal, is operatively mounted around the outer end of the trunnion 40 for sealing purposes during the last mentioned rotative action between the trunnion 40 and the manifold pipe 80. As shown in FIG. 4, the other end of the manifold pipe 80 is operatively connected to the port 81 of the accumulator 36. The accumulator 36 is fixedly mounted on the support structure 35 on the rotatable roof plate 22 by any suitable means, as by a pair of ring clamps 82.

Figure 8:
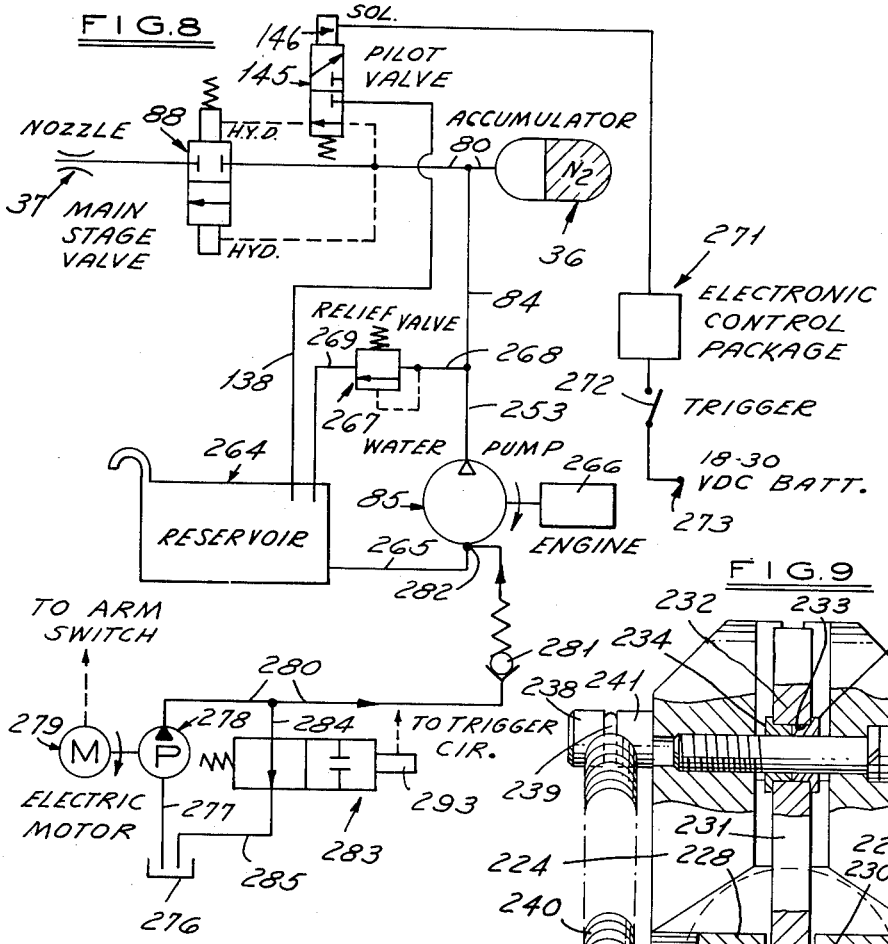
FIG. 8 is a schematic diagram of the overall water cannon system, including the water supply system, the additive injection system, and the control system for operating the water cannon.
Figure 11:
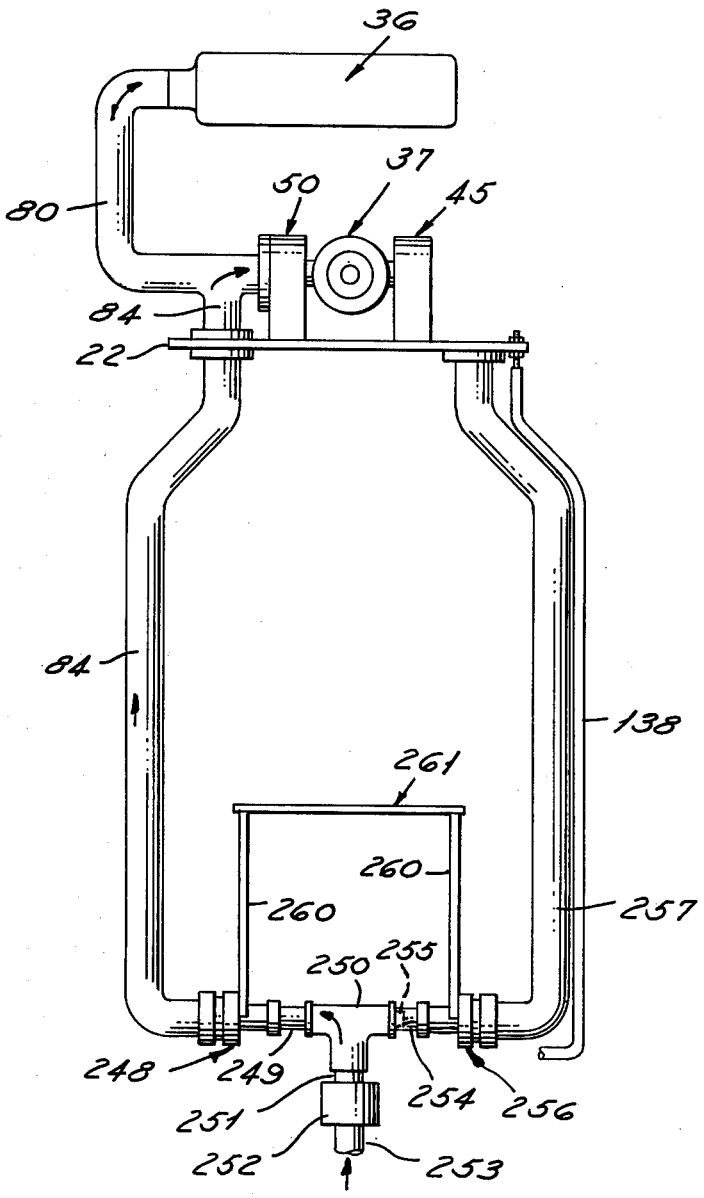
FIG. 11 is a fragmentary, elevational view of the operator's seat and rotatable mounting structure therefor, taken substantially along the line 11—11 of FIG. 2, and looking in the direction of the arrows.

As shown in FIG. 1, a water supply pipe 34 has its upper end attached to the manifold pipe 80, and its lower end extends down to the rotatable roof plate 22. As shown in FIG. 11, the pipe 84 is provided with a suitable flange which is secured to the top of the rotatable roof plate 22, and it communicates with a suitable opening through the plate 22, and with a second pipe portion 84 which has a suitable flange on its upper end that is fixedly secured by any suitable method to the lower side of the rotatable roof plate 22. The pipe portion 84 inside of the cupola 14 forms part of a support structure for an operator's seat 261 as shown in FIG. 11, and as described further in detail hereinafter. As schematically shown in FIG. 8, it will be seen that the pipe 84 is operatively connected to the water pump 85.

The accumulator 36 is an energy-storage device. It can provide additional fluid to the system when demand exceeds the flow available from the water pump 85. The accumulator 36 consists of a hollow cylindrical housing containing a sealed nitrogen gas-filled bladder, as schematically illustrated in FIG. 8. The accumulator port 81 connects the accumulator 36 with the water cannon supply line 84. When the aforementioned bladder is initially filled with nitrogen gas to a particular pressure (known as "pre-charge"), the bladder expands to fill the internal volume of the accumulator 36. In order for water to enter the accumulator 36, the pre-charge pressure must be overcome. As incoming fluid compresses the nitrogen, its pressure rises above the pre-charge level. If the accumulator is 50% filled with pressurized water, through the pipe 80, the resulting gas pressure is approximately twice the pre-charge pressure; that is, the product of gas pressure and gas volume is relatively constant. In one embodiment, the accumulator 36 in the water cannon system had a total volume of 5 gallons. It was pre-charged to 150 psi. The system relief valve 267 (FIG. 8) limited maximum pressure to 250 psi. Accordingly, approximately 2 gallons of water entered the accumulator 36 until the nitrogen was compressed to a volume of 3 gallons and a pressure of 250 psi. When the water cannon 37 was fired, the demand for flow reached 300 gallons per minute (GPM). Due to the size and power limitations, the water pump 85 could not deliver more than about 90 GPM. The accumulator 36 then functioned to rapidly discharge water to supplement the flow of water from the water pump 85, so as to provide a flow of water required to meet the demand.

As shown in FIG. 7, the numeral 88 generally designates a main stage valve which controls the flow of water into the barrel cavity 101 of the cannon 37. The main stage valve 88 includes an elongated valve stem 89 which has integrally formed on the front end thereof a valve plunger or valve element 90 which, when moved rearwardly to the position shown in FIG. 7, seals against a valve seat 91 to shut off flow of water from the cannon 37. The main stage valve 88 moves in a linear fashion along the longitudinal axis of the cannon 37. When the valve plunger 90 moves forward, or to the left from the position shown in FIG. 7, a flow path opens between the plunger 90 and the valve seat 91 to allow water to be discharged from the cannon 37.

The valve seat 91 is ring shaped, and it is seated loosely in an annular recess 92 formed in the cannon body 38 around the outlet end of the cannon chamber 70. The valve seat 91 is retained in the recess 92 by a coupling member 94. The valve seat 91 is loosely held so that it may function as a floating type valve seat, for alignment considerations and to permit efficient seating of the valve plunger 90 on the valve seat 91. As shown in FIG. 7, a threaded female recess 95 on the rear end of the coupling 94 receives the threaded male front end 96 of cannon body 38. It will be seen that the coupling 94 may be quickly and easily removed for replacing the valve seat 91, when necessary. A suitable preformed packing 98 is mounted between the coupling 94 and the cannon body threaded end 96. The coupling 94 is provided with suitable wrenchholes 97. The coupling 94 has a passage 93 therethrough which commences with a spherical radius adjacent the inlet and thereof. The passage 93 terminates in a constant radius.

As illustrated in FIG. 7, the cannon 37 includes a cannon body extension or barrel 101 which has its rear end seated in an annular recess 100 formed in the front end of the coupling 94. The front end of the extension 101 is seated in an annular recess 102 formed in the rear end of a second coupling 103. The cylindrical extension 101 is fixed by any suitable means to the couplings 94 and 103, as by welding. The cannon 37 also includes a nozzle 106 which has a threaded female recess 105 formed in its rear end for threadably mounting the nozzle 106 on the threaded male front end 104 of the coupling 103. A suitable preformed packing 112 is operatively mounted between the rear end of the nozzle 106 and a shoulder formed on the coupling 103. The nozzle 106 is provided with suitable wrench holes 107. The nozzle 106 is a high performance nozzle, and it provides a coherent stream of fluid due to its internal passage 108 which is formed with a spherical radius instead of a straight taper. The nozzle 106 is provided with a discharge port 109 formed in an integral nozzle tip 110.

As shown in FIG. 7, a fluid flow straightener, generally indicated by the numeral 111, is operatively mounted in the cannon extension 101. The flow straightener 111 is of a honeycomb construction, in that it comprises a cluster of small thin-wall tubes, each of which is disposed parallel to the axis of the cannon extension 101. The water passing through the valve seat 91 and into the extension 101 moves in a turbulent fashion. The extension 101 provides a chamber where the water velocity is reduced, so as to allow the turbulence to dissipate. The turbulence is further minimized by passing the water through the fluid flow straightener 111. Fluid leaving the straightener 111 moves directly into the contoured nozzle passage 108 where it is rapidly accelerated to a high velocity. It is the high velocity, and coherent or discrete discharge of water from the nozzle 106 which gives the water cannon 37 its effectiveness.

The main stage valve 88 is operated by the following described structure. As shown in FIG. 7, the main stage valve stem 89 extends rearwardly, or to the right, as viewed in FIG. 7, through a first axial bore 113 and a smaller diameter bore 114, and thence through a seal bore 118 and into a spring chamber 115. Operatively mounted in the seal bore 118 around the valve stem 89 is a suitable seal 116, which is preferably a spring-loaded "Teflon" seal that is retained in place by a threadably mounted seal retainer 117.

As shown in FIG. 7, the valve stem 89 has a reduced diameter rear end portion 126 which passes through an axial bore 127 in a piston 121. The piston 121 is secured on the valve stem portion 126 by a suitable washer 128, and a pair of suitable lock nuts 129 which are mounted on the threaded rear end of the valve stem portion 126. A cylindrical bumper 120 is mounted around the valve stem 89, adjacent the front end of the piston 121. The bumper 120 is made from any suitable material as, for example, a polyurethane material.

The piston 121 is slidably mounted in a cylinder chamber 123 formed in a piston cylinder 123. The front end of the piston cylinder 123 is slidably mounted in an enlarged diameter recess 124 at the outer end of the spring chamber 115. A suitable preform seal 125 is operatively mounted around the front end of the piston cylinder 123 for sealing engagement with the annular surface of the recess 124. The piston 121 is provided with a pair of suitable guide rings 142 mounted in annular recesses about the periphery of the piston. The piston 121 is also provided with a suitable annular seal 140 around the periphery thereof, and adjacent the front end thereof. The seal 140 may be of any suitable type, as for example, a spring loaded "Teflon" seal. A compression spring 141 is operatively mounted in the spring chamber 115, and has its rear end seated against the front end of the piston 121, and its front end seated against the front end wall of the spring chamber 115. The compression spring 141 normally biases the piston 121 ad the valve 88 rearward or to the right, as shown in FIG. 7, so as to move the valve plunger 90 into engagement with the valve seat 91.

As shown in FIG. 7, the outer end of the cylinder chamber 122 is enclosed by a cylinder cap 132. A suitable gasket 143 is mounted between the cylinder cap 132 and the rear end of the piston cylinder 123. As shown in FIG. 5, the piston cylinder 123 and the cylinder cap 132 are secured to the rear end of the cannon body 38 by any suitable means, as by a plurality of suitable socket head screws 133. As shown in FIG. 7, the extreme rear end of the valve stem portion 126 extends into an axial recess 134 formed in the cylinder cap 132. The recess 134 communicates with a drain passage 135 which is connected to a pipe elbow fitting 137, (FIGS. 4 and 5). As shown in FIGS. 4 and 5, the elbow fitting 137 is connected to a suitable tubing 138 which conveys water entering the recess 134 back to the reservoir or water supply tank 264 (FIG. 8).

It will be seen that valve plunger 90 is firmly connected to piston 121, enabling these two components to move as a unit. Compression spring 141 forces piston 126 rearward in its bore 122, seating plunger 90 against floating valve seat 91. The spring load is sufficient to overcome the frictional forces retarding rearward motion of the piston and plunger combination.

Water entering the hollow right trunnion 40 acts on plunger 90, tending to force it off its seat. The magnitude of this opening force ($F_o$) equals the water supply pressure times the effective area of the plunger 90. The effective area of the plunger 90 equals the area of the diameter at the plunger and valve seat interface, less the area of the valve stem 89 joining plunger 90 and piston 121.

By means of port 165 (FIG. 7), water passes into the pilot valve 145 (FIG. 6) and through the same, and back into cylinder port 156 (FIG. 7). The water is permitted to enter the spring chamber 115 containing compression spring 141. Water pressure acting on the effective area of the piston 121 tends to move the piston and plunger rearward, forcing the plunger 90 against the valve seat 91. The magnitude of this closing force ($F_c$) equals water pressure times the effective area of the piston 121. Effective area of the piston 121 equals the area of the piston diameter less the area of the valve stem 89 joining the plunger 90 and piston 121.

The forces acting on the plunger and piston combination consist of: $F_o$, tending to open; $F_c$, tending to close; and $F_s$ (force of spring), tending to close. The effective area of the piston 121 is significantly greater than the effective area of the plunger 90. With equal water pressure acting on these respective areas, $F_c$ greatly exceeds the valve of $F_o$. Therefore, the sum of closing forces ($F_c + F_s$) exceeds the opening force ($F_o$), and the plunger 90 remains tightly pressed against its valve seat 91.

If, however, the pressure acting on the piston 121 is suddenly removed, $F_c$ disappears. Opening force $F_o$ greatly exceeds $F_s$, and the plunger 90 rapidly moves forward. Movement of the plunger 90 off its seat 91 allows supply water to flow into the extension 101 and nozzle 106, discharging the cannon 37. Forward travel of the plunger 90 is limited by resilient bumper 120.

When supply pressure is reapplied to the piston 121, ($F_c + F_s$) exceeds $F_o$, moving the plunger and piston combination rearward, forcing the plunger 90 against its seat 91, stopping the cannon discharge. It can be seen that the operational status of the water cannon 37, whether it is closed or discharging, is determined by the presence or absence of pressure in the spring chamber 115. With supply pressure applied, the piston 121 is forced rearward, closing the main stage valve 88. With supply pressure blocked and the spring chamber 115 connected to drain, the plunger and piston combination moves rapidly forward to the open position. Control of pressure conditions in the spring chamber is exercised by pilot valve 145.

As shown in FIG. 5, the pilot valve assembly is generally indicated by the numeral 145, and it is carried on the underside of the cannon body 38 and secured thereto by any suitable means, as by a plurality of socket head screws 222. The pilot valve 145 is actuated by a solenoid, generally indicated by the numeral 146 in FIGS. 5 and 6. Pilot valve 145 is a two-position valve to control the water flow to and from three ports, as described hereinafter.

Figure 6:
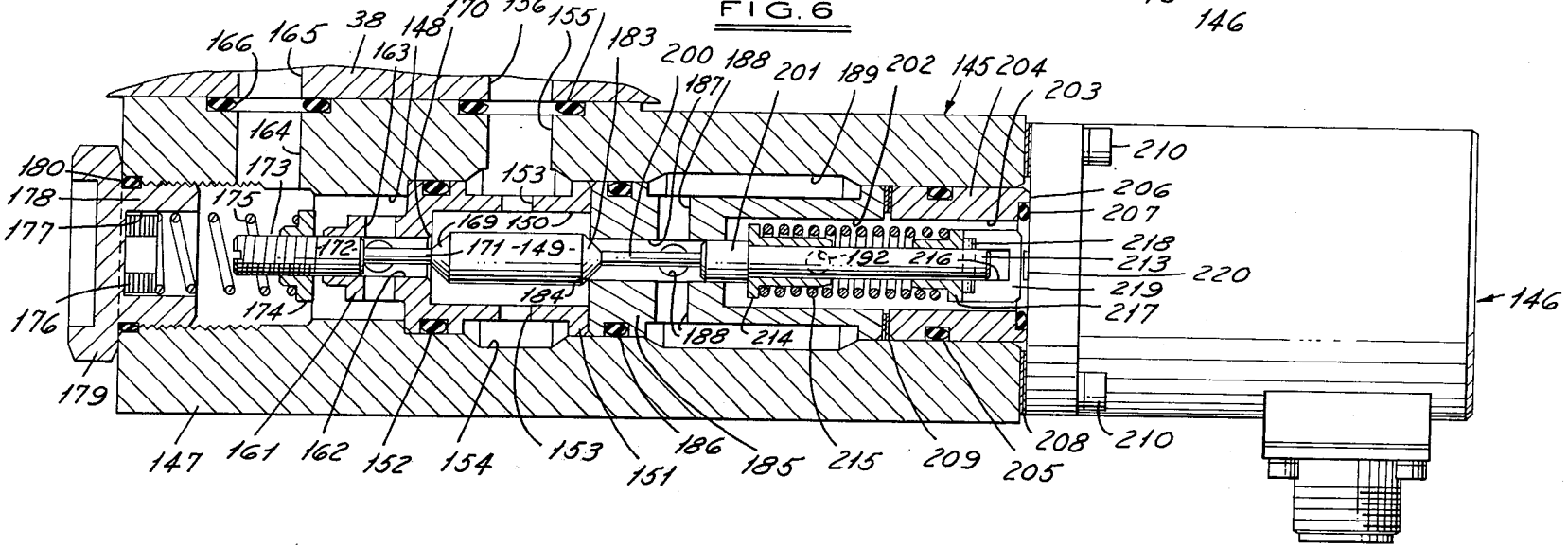
FIG. 6 is an enlarged, elevational section view of the pilot valve shown on the underside of the water cannon apparatus in FIG. 5.

As shown in FIG. 6, the pilot valve 145 includes an elongated valve body 147 through which is formed a stepped bore 148. The numeral 149 designates a poppet valve which has an elongated cylindrical body that is operatively mounted in a poppet valve chamber 150 formed in a valve sleeve 151. A suitable preformed seal 152 is operatively mounted in an annular recess around the outer periphery of the sleeve 151. The poppet valve chamber 150 communicates through a plurality of radial bores 153 with an annular chamber 154 that is formed in the valve body 147. The annular chamber 154 communicates with a bore or passage 155 which communicates with a cylinder port 156. As shown in FIG. 7, the cylinder port 156 communicates through a bore 157 with the spring chamber 115 and piston chamber 122. A suitable preformed seal 158 is mounted in the valve body 147 about the exit end of the passage 155.

As shown in FIG. 6, the valve sleeve 151 has a reduced diameter extension 161 formed on the front end thereof. The poppet valve chamber 150 communicates with an axial bore 162 formed through the sleeve extension 161. The bore 162 communicates through a plurality of radial bores 163 with the stepped bore 148. The bore 148 communicates with a radial bore or passage 164, which in turn communicates with a pressure port 165. As shown in FIG. 7, the pressure port 165 communicates with the cannon chamber 70. A suitable preformed seal 166 is operatively mounted around the outer end of the bore 164.

As shown in FIG. 6, the poppet valve 149 is provided on the front end thereof with a conical surface or poppet valve element 169 which mates with a circular seat 170 formed on the sleeve 151 about the entrance end of the axial bore 162. A valve stem portion 171 has one end integrally attached to the outer end of the poppet valve element 169, and the other end thereof is integrally attached to a larger diameter valve stem 172 which is slidably mounted in the axial bore 162. The valve stem portion 171 is of a diameter smaller than the bore 162 so as to permit water flow thereby and through the bore 162. The large diameter valve stem portion 172 forms the front axial guide means for the poppet valve 149.

As shown in FIG. 6, the outer end 173 of the valve stem portion 172 is threaded, and it has threadably mounted thereon, a spring retainer 174. A compression spring 175 has one end operatively mounted around the valve stem portion 173, and seated on the spring retainer 174. The other end of the spring 175 is seated against a shim means 176 that is carried in an annular, axial recess 177 formed in a plug 178. The plug 178 is threadably mounted in the front end of the stepped bore 148 and it is provided with a plug head 179. A suitable preform seal 180 is mounted around the plug 178.

As shown in FIG. 6, the poppet valve 149 is provided on the rear end thereof with a second poppet valve element 183 which has a conical surface and which mates with a circular seat 184 formed on the front end of a second valve sleeve 185 which is mounted in the stepped bore 148. A suitable preformed seal 186 is mounted around the periphery of the sleeve 185. The valve seat 184 communicates with an axial bore 187 which in turn communicates with a plurality of radial bores 188. The radial bores 188 communicate with an annular drain chamber 189 that is formed around the sleeve 185 in the wall surface of the stepped bore 148. The drain chamber 189 communicates through a passage 192 with an elbow fitting 193, as shown in FIG. 5. The elbow fitting 193 is operatively connected to a tubing 194 for draining water from the chamber 189. The tubing 194 is connected by means of a fitting 195 and an elbow 196 with a passage 197 formed through the cylinder cap 132. The passage 197 communicates with the recess 34 and the drain passage 135. The rear end of the poppet valve 149 is guided in its axial movement by a valve stem portion 201 which is slidably mounted in the axial bore 188. The valve stem portion 201 is interconnected with the outer end of the poppet valve element 183 by a reduced diameter valve stem portion 200 which permits fluid flow therearound through the bore 187.

As shown in FIG. 6, the sleeve 185 is provided on the rear end thereof with an enlarged bore 202 which communicates with the bore 187. A spacer sleeve 204 is mounted in the stepped bore 148, in the right end thereof, and in a position adjacent to the rear end of the sleeve 185. The spacer 204 is spaced from the sleeve 185 by suitable shims 209. The spacer sleeve 204 has an axial bore 203 formed therethrough which is of the same size as the valve sleeve bore 202. A compression spring 215 is operatively mounted in a spring chamber formed by the bores 202 and 203. The front end of the spring 215 is seated against a flange formed on a spring guide 214, which is seated on a reduced diameter extension 213 of the valve stem. The spring guide 214 is seated against a shoulder formed at the junction between the valve stem portion 201 and valve stem portion 213. The rear end of the spring 215 is seated on a spring retainer 217 which is slidably mounted on the reduced diameter valve stem portion 213. A suitable preformed seal 205 is formed on the outer periphery of the spacer sleeve 204. The rear or outer end 206 of the spacer sleeve 204 is seated against the front end of the housing of the solenoid 146. A suitable preformed seal 207 is operatively mounted in an annular recess formed at the outer end of the spacer sleeve bore 203. Suitable shims 208 are also disposed between the outer end of the valve body 147 and the housing of the solenoid 146. The shims 208 are selected so as to provide a flush contact between the outer end 206 of the spacer sleeve 204 and the housing of the solenoid 146. The solenoid 146 is fixedly secured to the rear end of the valve housing 147 by a plurality of suitable socket head screws 210.

As shown in FIG. 6, a spring retainer 217 is provided with an axial bore 216 which extends from the inner end thereof and inwardly for a predetermined distance. The outer end of the valve stem portion 213 is slidably mounted in the bore 216. A spring pin 218 is mounted in a transverse bore formed through the valve stem portion 213. The spring pin 218 is slidably mounted in a longitudinally extended transverse slot 219 formed through the outer end of the spring retainer 217. The numeral 220 designates the solenoid plunger for the solenoid 146, and in the inoperative position, it is spaced by a suitable air gap from the outer end of the spring retainer 217. The shims 209 are selected so as to give a 0.003 to 0.005 inch air gap between the deactivated solenoid plunger 220 and the outer end of the spring retainer 217. The shims 176 are selected so as to give a 1 ± 0.25 lb. load when poppet valve 149 is seated against the seat 184.

In the normal condition of operations, that is when the cannon 37 is not discharging, the poppet valve 149 is forced to the right, as viewed in FIG. 6, by the action of the compression spring 175 until the conical valve element 183 seats against the valve seat 184. A pressure type seal is established because the poppet valve 149 is clamped against the valve seat 184 by the spring 175 and the force of supply water pressure acting on the left end of the poppet valve 149. With the poppet valve 149 in the position shown in FIG. 6, the chamber 150 is connected to the water supply so as to cause the main stage valve 90 to close. When the cannon 37 is discharged, solenoid 146 is energized by a 24-volt direct-current signal from the electronic control package 271 (FIG. 8). The solenoid plunger 220 is extended to the left, as viewed in FIG. 6, so as to force the poppet valve 149 to the left, and with the poppet valve element 169 in seating engagement with the valve seat 170. The last mentioned action blocks the supply water from reaching the spring chamber 115 and connects this chamber to the drain line 194. This action permits the main stage valve 90 to rapidly open, causing the water cannon 37 to discharge.

Solenoid 146 remains activated until the 24-volt DC pulse ends. The pulse period is approximately 0.3 seconds. When the solenoid 146 deenergizes, the poppet valve 149 is forced to the right, as viewed in FIG. 6, so as to reconnect the spring chamber 115 to the water supply and to close the main stage valve 90.

Solenoid 146 has the capability of pushing and holding a 20-pound load over a 0.125 inch stroke. This is accomplished by using two separate coils 291 and 292 (FIG. 12A). A "Pull-in" or work coil 291 having a relatively high power consumption, is used to initiate movement of the applied load. When the end of the solenoid stroke has been reached, the "pull-in" coil 291 is automatically disconnected and a "holding" coil 292 is energized. The holding coil 292 is capable of holding the full rated load, yet it demands only about 20% of the power required by the pull-in coil 291.

If the solenoid armature plunger 220 is physically restrained from moving its normal 0.125 inch stroke, the pull-in coil 291 remains energized and the solenoid 146 will soon overheat. This danger is eliminated because of the structural design of the pilot valve 145. As will be seen from FIG. 6, the solenoid plunger 220 does not push directly against the end of a rigid poppet valve. Instead, the solenoid plunger 220 contacts the outer end of the spring retainer 217, and all force is transmitted to the poppet valve 149 through the compression spring 215 and the spring guide 214. The last mentioned components are constructed so as to allow the poppet valve 149 to seat on the seat 170 before the solenoid 146 has reached the end of its stroke. The spring retainer 217 slides on the valve stem portion 213 and compression spring 215 then deflects to permit the solenoid 146 to complete its stroke. The use of a compliant connection link, as the spring 215, between the solenoid 146 and the poppet valve 149 assures proper operation of the solenoid 146 and also permits the added function of compensating for wear of the conical surfaces of the poppet valve elements 169 and 183, and their mating valve seats 170 and 184, respectively.

Figure 9:
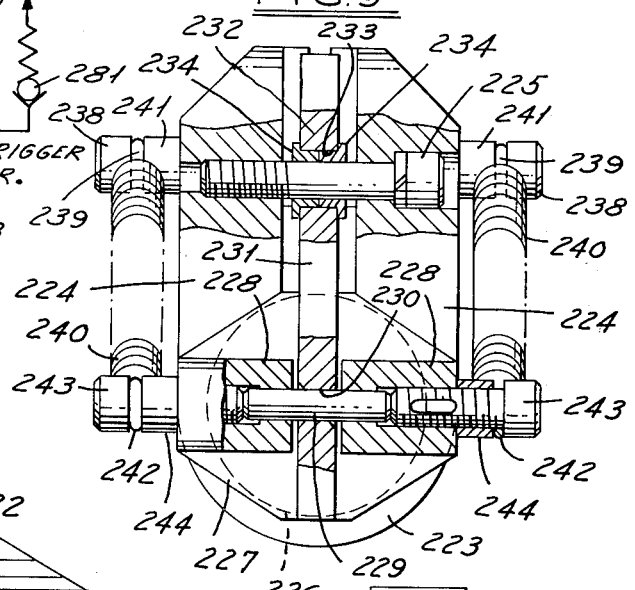
FIG. 9 is a front elevation view of a water cannon nozzle valve employed in the invention, taken along the line 9—9 of FIG. 10, and looking in the direction of the arrows.
Figure 10:
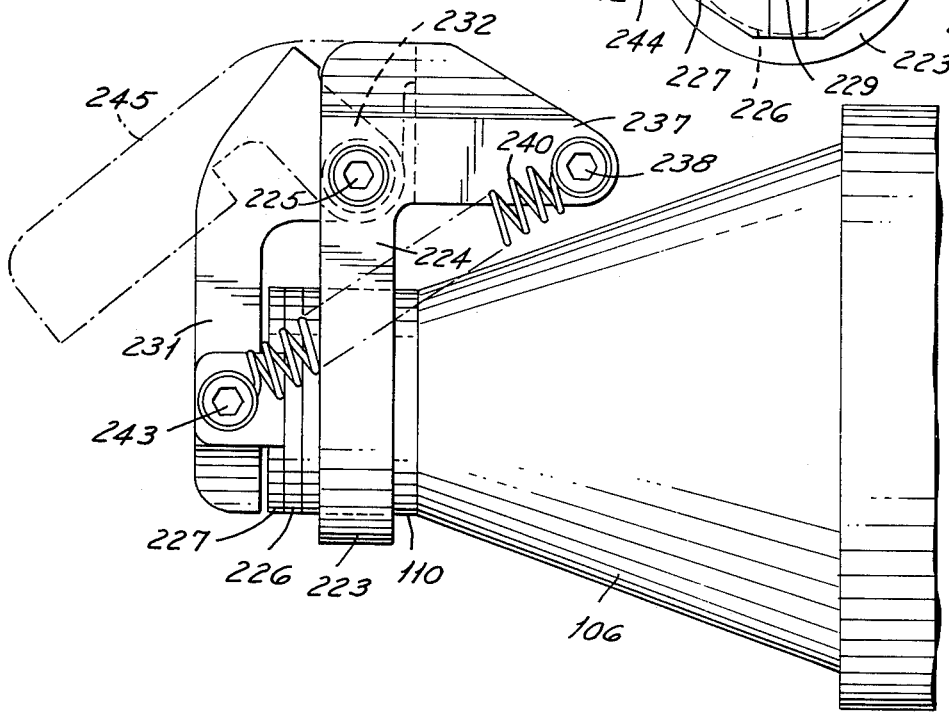
FIG. 10 is a right side elevation view of the water cannon nozzle valve shown in FIG. 9.

FIGS. 9 and 10 illustrate a nozzle valve which may be employed on the outer end of the nozzle 106. The nozzle valve includes a mounting bracket for mounting the valve on the nozzle 106. The mounting bracket includes a circular or bight portion 223 which is adapted to be mounted over the nozzle tip or spout 110. The nozzle valve mounting bracket further includes a pair of spaced apart bracket legs 224 which have their lower ends integral with the bracket portion 223, as shown in FIG. 9. As shown in FIG. 9, the bracket legs 224 are biased toward each other to clamp the mounting bracket on the nozzle tip 110 by a suitable machine screw 225. The nozzle valve includes a circular nozzle seal 226 which comprises an annular flexible seal that is mounted on a seal carrier disc 227 by any suitable means, as by a suitable adhesive.

The seal carrier disc 227 is supported by means of a pin 229 on the lower end of a lever 231. As shown in FIG. 9, the pin 229 is fixedly mounted in a transverse bore 230 formed through the lever 231. The outer ends of the pin 229 are each fixed in a bore in a block 228, as by a press fit. The blocks 228 are fixed to the seal carrier disc 227 by any suitable means, as by welding. As best seen in FIG. 10, the lever 231 is provided with an inwardly extended, integral lever arm 232 on the upper end thereof. As shown in FIG. 9, the lever arm 232 is provided with a transverse bore 233 in which is operatively mounted a pair of sleeve bearings 234. A mounting bracket machine screw 225 is rotatably mounted through the sleeve bearings 234 so as to provide a shaft for rotatably mounting the lever 231.

FIG. 10 shows the lever 231 in a solid line position wherein the nozzle seal 226 is in a position to close off the outlet port 109 in the nozzle tip 110. The numeral 245 indicates in broken lines the open position to which the lever 231 is swung by the water being forced out of the nozzle 106, so as to move the seal 226 to an open position.

As shown in FIGS. 9 and 10, the lever 231 is normally biased to the valve closing position by a pair of tension springs 240, which are disposed on the outer sides of the mounting bracket legs 224. As shown in FIG. 10, each of the mounting bracket legs 224 is provided with an inwardly extended bracket arm 237. The upper end of the adjacent spring 240 is fixed by a suitable machine screw 238 to the adjacent bracket arm 237. As shown in FIG. 9, each of the upper spring end loops 239 receives a machine screw 239, and a sleeve bearing 241 is disposed between the spring end loop 239 and the side face of the adjacent bracket arm 237. The lower spring end loops 242 are similarly secured to the outer ends of the adjacent blocks 228. Each of the lower spring end loops 242 is secured to the adjacent block 228 by a suitable machine screw 243. A suitable sleeve bearing 244 is disposed between the outer face of each block 228 and the adjacent spring end loop 242.

The nozzle valve shown in FIGS. 9 and 10 is employed to stop the water from dripping out of the end of the nozzle 106 when the main stage valve 90 closes. If the nozzle valve shown in FIGS. 9 and 10 is not mounted on the nozzle 106, then the water remaining in the nozzle 106 would drain outwardly and down over the vehicle 10. The nozzle valve thus functions to provide a water saving device.

It will be seen that the tension springs 240 maintain an effective closing torque on the arm 231. However, when the cannon 37 is triggered, the water pressure is sufficient to blow the nozzle valve open so as to move the lever 231 to the broken line position indicated by the numeral 245 in FIG. 10. After a firing cycle, the tension springs 240 automatically move the lever 231 to the solid line closed position shown in FIG. 10. During a cannon firing action, it only takes a very small force to maintain the lever 231 in the open position 245.

FIG. 11 illustrates a structure for providing the water supply to the rotatable cannon 37, and for providing a seat for the operator. As shown in FIG. 11, the numeral 261 generally indicates a seat for the operator of the cannon 37. The seat 261 may take any suitable form, and it is supported by a pair of spaced apart seat brackets 260 which have their lower ends fixed by any suitable means, as by welding, on a pair of short length flanged pipe connectors 248 and 256. The flanged pipe connector 248 is connected by a short pipe 249 to one side of a pipe tee 250. The flanged pipe connector 248 is also connected to a vertical portion of the water supply line 84. The water supply line 84 is operatively attached by suitable flanged means to the rotatable plate 22 and to provide flow therethrough, to provide one supporting leg for the seat 261.

The second supporting leg for the seat 261 comprises a vertical pipe 257 which has its upper end flanged and fixed by any suitable means to the rotatable plate 22. The lower end of the pipe 257 is turned inwardly, and is operatively attached to the flanged pipe connector 256. The flanged pipe connector 256 is connected by a short pipe 254 to the pipe 250. A suitable plug 255 prevents flow of water into the pipe 257. The pipe tee 250 is connected by a suitable pipe to a conventional rotatable union, such as a Deublin rotating union. The rotating union 252 is operatively supported in the vehicle 10 and is connected by the pipe 253 to a water supply tank or water reservoir 264. (FIG. 8).

It will be seen that an operator sitting on the seat 261 can train the cannon in aximuth by engaging his feet with the floor of the vehicle, and with body action turn the seat supporting pipes 84 and 257, and the support plate 22. The drain pipe 138 would also be provided with a suitable rotating union, similar to the union 252 to permit rotation of the cannon 37 and yet provide drainage through the line 138 back to the reservoir 264.

OPERATION

The illustrative embodiment of the invention may be understood by referring to the system schematic illustrated in FIG. 8. The first step in firing the water cannon 37 is the engagement of the water pump drive shaft for driving the water pump 85. The engine 266 driving the pump 85 is then brought up to proper operating speed.

As the water pump 85 rotates, water is drawn from the reservoir 264 through the pipe 265 to the intake end 282 of the pump 85. The pump 85 supplies water under pressure through the pipes 253 and 268 to the by-pass or relief valve 267. Water also is supplied through the pipes 84 and 80 to the accumulator 36 and the water cannon 37.

The water under pressure entering the water cannon 37 acts against the valve plunger 90, and because of the de-energized condition of the pilot valve 145, the water under pressure passes into the spring chamber 115 and the front end of the piston chamber 122. Because of the area of the piston 121 exceeds the area of the valve plunger 90, the valve plunger 90 is drawn tightly against its seat 91, keeping the main stage valve closed. Since there is no open flow path available to the water delivered by the pump 85, the supply pressure rises rapidly until the precharge pressure of the accumulator 36 is exceeded. At this time, water begins flowing into the accumulator 36, to charge it with a quantity of water.

As the incoming water compresses the nitrogen contained within the bladder of the accumulator 36, the water pressure rises. The pressure increase in the accumulator 36 is limited by the setting of the system relief valve 267. In one embodiment, the relief valve 267 was set to open when the water pressure reached 250 psi. At this point, the accumulator 36 contained approximately 2 gallons of water. All pump flow then passes through the relief valve 267 and returns through the pipe 269 to the reservoir 264. The system is now capable of being fired.

When the gunner or operator is prepared to discharge the cannon 37, he depresses one of the trigger switches 65 forming the trigger switch assembly 272, (FIG. 12A). The operator depresses either one of the trigger switches 65 contained in the gunner's control grips 64. When either trigger switch 65 is closed, the electronic control package 271 begins emitting carefully spaced 24-volt DC pulses of 0.3 second duration. Each pulse momentarily energizes the solenoid 146 on the pilot valve 145. When the pilot valve solenoid 146 is energized, the spring chamber 115 and the front end of the piston chamber 122 is connected to the drain line 194, and thence through the passages 197 and 135 to the drain line 138 which is connected to the reservoir 264. The main stage valve plunger 90 opens rapidly due to the high force acting thereon. As the main stage valve plunger 90 opens, a flow path develops which permits supply water to enter the extension 101 and nozzle 106 where it is accelerated and discharged as a coherent or discrete projectile of water.

The sudden demand for fluid flow causes the system pressure to drop below 250 psi. The relief valve 267 closes rapidly, as 250 psi is required to hold it open. All water from the pump 85 then goes directly to the cannon 37. However, pump flow is not sufficient to supply all the flow demanded. As the system pressure drops below 250 psi, the accumulator 36 discharges to maintain equality between its gas and water pressures. Accordingly, the pump 85 and the accumulator 36 combine to provide very high flow rates for the 0.3 second duration of the firing pulse. During this short period, approximately 1 gallon of water is discharged from the nozzle at a high velocity.

When the 0.3 second firing pulse ends, the pilot valve 145 returns to its de-energized state, reconnecting supply water to the main stage spring chamber 115 and piston chamber 122. As the last mentioned chambers rapidly fill, the valve plunger 90 is drawn back against its seat 91, shutting off the cannon discharge. The system pressure again starts to rise, refilling the accumulator 36 until the setting of the relief valve 267 is reached. This "off" period from 0.7 to 1.0 seconds duration, during which the system prepares itself for the next firing pulse, is also controlled by the electronics control package 271.

The charge and discharge cycle from 1.0 to 1.3 seconds duration can be repeated until the water supply in the reservoir 264 is exhausted. However, the electronic control package 271 will cease emitting pulses after three shots, even though either one of the trigger switches 65 remains closed. Normally, sufficient mist is generated during firing to partially obsure the target from the gunner's sight. Automatically limiting the gunner to a three-shot series allows him to readily reacquire the target, and such action also aids in water conservation. To continue firing after three shots, the trigger must be fully released, then reactuated.

FIG. 8 includes a system for including additives in the water supply. As shown in FIG. 8, an additive reservoir 276 is connected by a pipe 277 to an additive supply pump 278 which is driven by a drive motor 279. The additive pump 278 is connected by a pipe 280 and a relief valve 281 to the intake end 282 of the water supply pump 85. When the entire system arm switch 289 (FIG. 12) is actuated to start the entire system, power is also supplied to the electric motor 279 that drives the additive pump 278. Additive is drawn from the reservoir 276 and pumped through the pipes 280 and 284 and through the normally open flow control valve 283 and back through the pipe 285 to the reservoir 276. The additive does not mix with the system water due to the relief valve 281 which is spring loaded to open at approximately 100 psi. When either one of the triggers 65 is depressed, the injection control solenoid 293 is actuated and the injection control valve 283 is shifted against spring pressure to a closed position to block the flow path through the pipe 285 back to the reservoir 276. Flow from the pump 278 then flows through the check valve 281 and into the intake end 282 of the main water supply pump 85. The additive is thoroughly mixed with the water in the pump 85 before being discharged from the cannon.

The additives may comprise any desired type. The additives may include, but are not limited to, identification dyes, skin or eye irritants, foul smelling compounds, and compounds which cause the water to become very slippery and adherent, increasing the likelihood of a rioter to slip and fall. It will be understood that one or a combination of additives can be employed.

The additives employed may also include an additive to minimize misting of a water stream as it emerges from the cannon. Normally, the water slug or discrete coherent stream of water leaving the nozzle 108 immediately begins to disperse. This action is due to the effects of air resistance on the water stream. By treating the water with certain additives, the water tends to be more coherent and to cling together to form globules, rather than a mist, and to increase the effective density of the water stream. One suitable additive for achieving the last described action is an additive available on the market from the Nalco Chemical Company of 2901 Butterfield Road, Oak Brook, Illinois, and identified as BX-254 polymer, which is a hydrocarbon polymer.

Electronic Control Package

Figure 12:
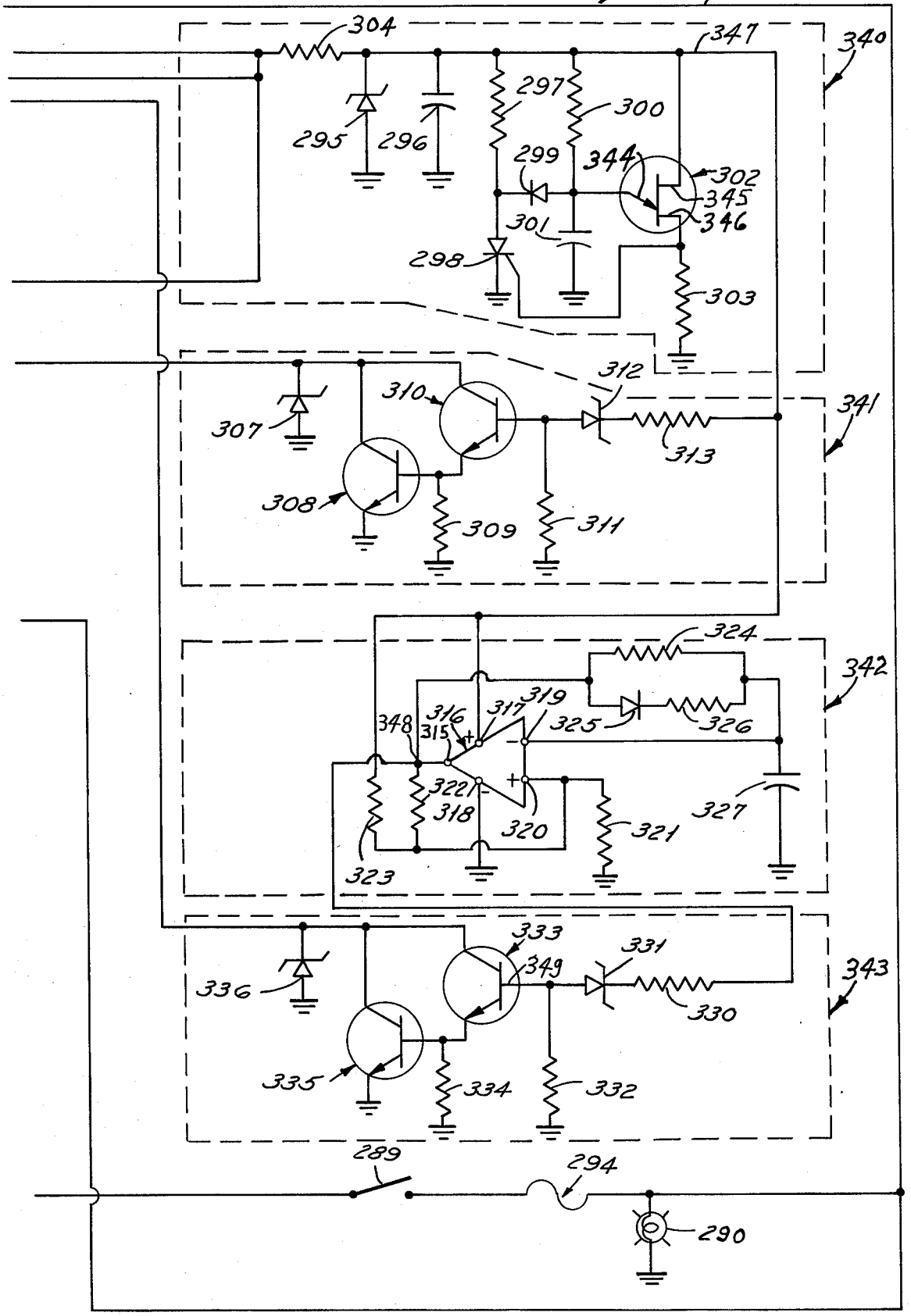
FIGS. 12 and 12A show an electrical schematic of an electronic control system for operating the water cannon apparatus of the present invention.
Figure 12A:
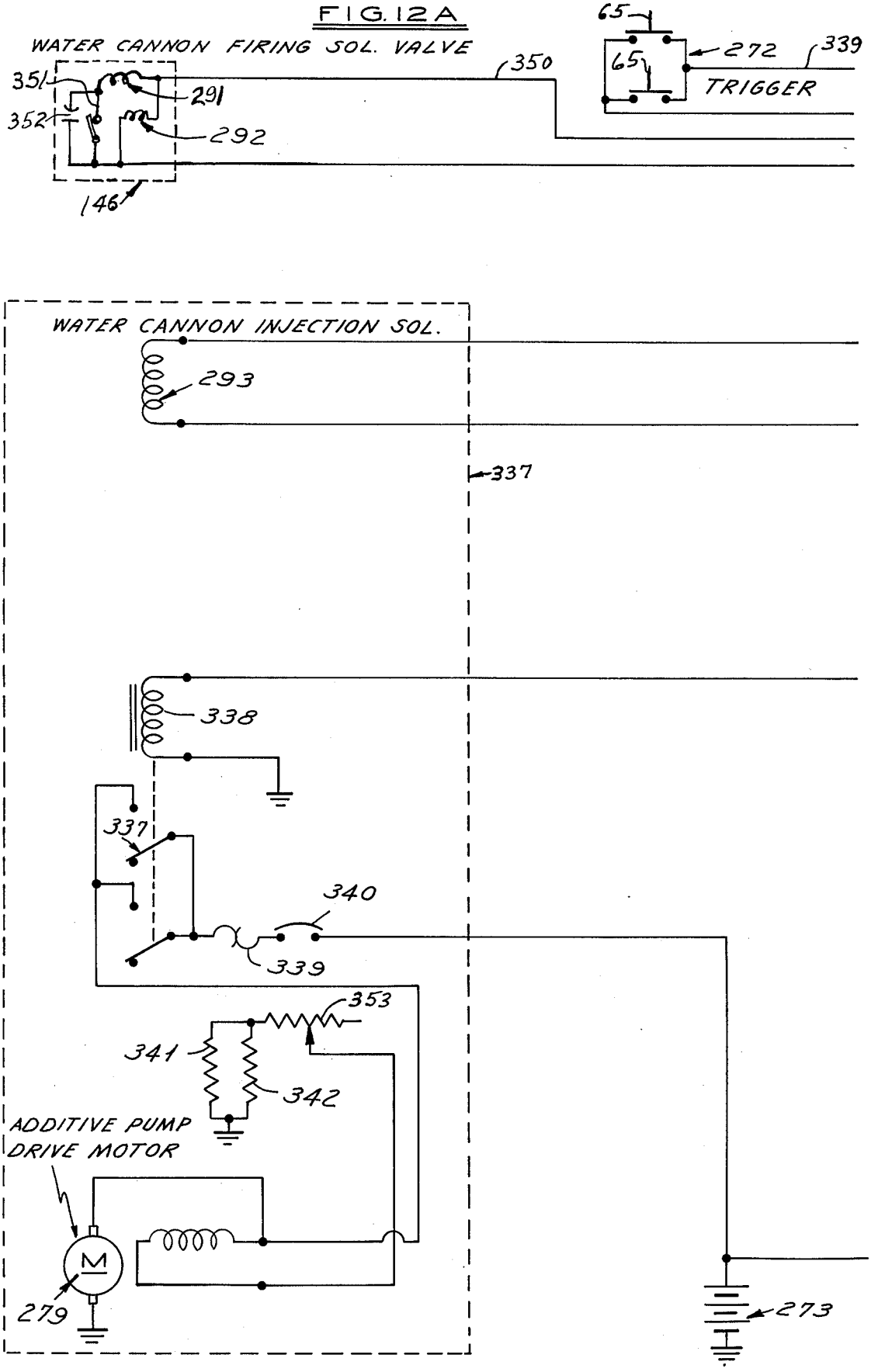

In order to energize the electronic control package 271, the gunner closes the arm switch 289 which energizes the electronic control package 271, shown in detail in FIGS. 12 and 12A, to prepare it for firing. The electronic control package 271 is a pulse generator and if the arm switch 289 is not closed, the triggers 65 will not function even if they are depressed. Accordingly, the arm switch 289 also functions as a safety device.

When the arm switch 289 is closed, an indicator or pilot light 290 is energized, to tell the gunner that the system is energized and that the triggers 65 are ready for use. As shown in FIG. 12A, the individual triggers 65 are wired in parallel and comprise the switch assembly generally indicated by the numeral 272. The switches 65 provide the option of either a left handed trigger or a right handed trigger to suit the individual operating the cannon. Either or both of the triggers 65 may be squeezed, and the first one to make contact is the controlling switch.

As shown in FIG. 12, the electronic control package 271 includes four basic functional sections, namely a trigger timer, generally indicated by the numeral 340, an injection solenoid driver, generally indicated by the numeral 341, an asymmetrical pulse generator, generally indicated by the numeral 342, and a firing solenoid driver, generally indicated by the numeral 343.

The trigger timer 340 includes the circuitry surrounding the transistor 302. The injection solenoid driver 341 includes the circuitry surrounding the transistors 308 and 310. The asymmetrical pulse generator 342 includes the circuitry associated with the triangular block operational amplifier designated generally by the reference numeral 316. The firing solenoid driver 343 includes the circuitry associated with the transistors 333 and 335. In FIG. 12A, the reference numeral 146 generally designates the water cannon firing solenoid, and the reference numeral 337 generally designates the water cannon additive injection system, both of which will be described in detail hereinafter.

As shown in FIG. 12A, the power source for the electronic package 271 comprises a 24-volt battery, designated generally by the reference numeral 273. The negative side of the battery 273 is grounded. The positive side of the battery 273 is available for the primary function of supplying the power for the water cannon firing circuits, and for the secondary function of operating the water cannon additive injection system 337.

As shown in FIGS. 12 and 12A, the positive side of the battery 273 is connected to the arm switch 289 which comprises the power switch for the water cannon firing circuits 340, 342 and 343 and the water additive injection system circuit 341. The line designated by the numeral 339 in FIGS. 12 and 12A is termed a switched power line that is distributed in several places. The switched power line 339 is connectable to the relay coil 338 which comprises a part of the water additive injection system 337, as described in detail hereinafter. The remaining switched power fed through the trigger switch assembly 272 is applied to one side of the water cannon firing solenoid, generally indicated by the numeral 146 in FIG. 12A. The solenoid 146, however, is not energized because the other side of the solenoid is connected to circuit elements which are functioning so as to provide an open circuit, although voltage is applied to said one side of the solenoid 146. The same situation is present in regard to the water cannon additive injection solenoid 293. As shown in FIG. 12, the switched power line 339 is connectable through the switch assembly 272, through the resistor designated by reference numeral 304, to the top of the zener diode 295, which diode is part of the overall trigger timer 340.

The voltage associated with the battery 273 may range from 18 to 30 volts, depending on the battery's state of charge, the vehicle generator regulator settings, and so forth. The resistor 304 and the zener diode 295 function in combination to reduce the voltage and regulate it at a plus 15 volts.

The capacitor 296 in the trigger timer 340 is a multifunction element, in that it performs transient filtering and energy storage. The capacitor 296 filters out high frequency transient voltage spikes, changes, and noise. The capacitor 296 also provides an energy storage means whereby when the firing circuits operate, the capacitor 296 tends to hold the voltage up long enough for proper action on the circuits.

The elements comprising the trigger timer directly include a resistor 300, a capacitor 301, a uni-junction transistor 302 having an upper base 345 and a lower base 346, and a uni-junction transistor load resistor 303. When the arm switch 289 and the trigger switch assembly 272 are both closed, a voltage of 15 volts is applied to the resistor 300 and the transistor 302. Resistor 300 and capacitor 301 function as a combination and serve as a timing device. The voltage developed across the capacitor 301 is related to the size and rate of charge of said capacitor. The rate of charge of the capacitor 301 is determined by the resistor 300. As the voltage across the capacitor 301 continues to rise, it approaches approximately one-half the 15-volt supply. Up until that point the emitter 344 of the transistor 302 is essentially inactive, and it functions like an open circuit. The reference numeral 298 designates a silicone controlled rectifier which at this time is also acting as an open circuit, so that up until this point in time, the transistor 302 and the silicone controlled rectifier 298 are out of action.

When the voltage across capacitor 301, in relationship to the voltage applied across the total uni-junction transistor 302, stands in the relationship of the intrinsic stand-off ratio of the transistor 302, which ratio varies typically from 0.5 to 0.7, the uni-junction transistor 302 suddenly goes into conduction. This action occurs when the voltage across the capacitor 301 approaches approximately 8 volts. A high conduction path then suddenly exists between the emitter 344 and the lower base 346, thereby causing a pulse of current to be passed through resistor 303 and generating a voltage. The last mentioned combination of voltage and current is sufficient to turn on suddenly the silicone controlled rectifier 298, or cause it to go into its high conduction state. When the silicone controlled rectifier 298 is turned on suddenly, the voltage developed across said rectifier suddenly becomes very small, approximating 1 volt. Also, there is a sudden increase in current through the resistor 297. The sudden increase in current through resistor 297 causes the regulating diode 295 to starve, thereby causing the supply voltage between wire 347 and ground to drop below 5 volts. When the silicone controlled rectifier 298 goes into its high conduction state, it continues in said high conduction state until all the power is removed by either disconnecting the trigger switch assembly 272, or the power arm switch 289, at which time said rectifier 298 will automatically reset into its non-conducting state.

The reference numeral 299 designates a blocking diode. When the silicone controlled rectifier 298 is non-conducting, or in its low conduction state, the voltage across said rectifier will be essentially the power supply voltage since there will be essentially no current flow through resistor 297. The function of the blocking diode 299 is to prevent the voltage across said rectifier 298 from being fed into the timer capacitor 301, and altering the timing cycle. After the trigger timer 340 has accomplished its function and has timed out, and rectifier 298 is in its high conduction state, the voltage across it approximates zero, and the blocking diode 299 under those conditions functions to discharge the timer capacitor 301, as completely as possible. After the timer capacitor 301 is discharged, and the triggers 65 released and non-energized, and then energized again, then the trigger timer 340 again starts from essentially zero time.

The circuitry of the trigger timer 340 is designed so that the triggered state occurs approximately 2½ seconds after application or energizing of either one of the triggers 65. The length of time that it takes from closure of either one of the triggers 65 to the triggered state is determined primarily by the resistor 300, the capacitor 301, and the uni-junction transistor 302. It will be seen that the trigger timer 340 controls the duration that the injection solenoid driver circuit 341 is energized, and it also controls the length and time that significant voltage is applied to the asymmetrical pulse generator 342.

The reference numeral 342 generally designates the asymmetrical pulse generator, and the primary element of said pulse generator is an operational amplifier, generally designated by the numeral 316. The operational amplifier 316 functions as a comparator device which operates so that any potential difference existing between the amplifier terminals 319 and 320 is amplified with a high gain, in excess of 1,000. The output voltage of the operational amplifier 316, which appears at the junction point designated by the numeral 348 is based on the high gain and is constrained to lie at two states. One state is very low; that is, a voltage approaching ground or zero, but it could possibly be as high as 1 volt. The other state would approach the voltage applied to the amplifier terminal 317 which may be termed the supply voltage. It will be seen that the voltage appearing at the junction point 348 is constrained to lie at either a voltage approximating zero, or a voltage approximating the supply voltage.

The negative input terminal 319 of the operational amplifier 316 may be referred to as the inverting input. The plus terminal 320 on the operational amplifier 316 may be referred to as the non-inverting input terminal. The output terminal of the operational amplifier 316 is designated by the numeral 315. The operational amplifier terminal 317 is connected to the positive power supply voltage. The operational amplifier ground terminal is designated by the numeral 318 and comprises the return side of the applied power. The operational amplifier non-inverting input terminal 320 is biased by the resistor 323 so as to allow single ended operation of the pulser. A voltage divider comprising the resistors 321 and 322 is connected to the non-inverting input terminal 320. The output at the terminal 315 can exist at only 2 levels. It can exist either at a value from close to zero; that is, it can operate at a value of from about 0 to 1 volt, or it can be operated very close to saturation of the amplifier 316, which would be about 15 volts.

The operation of the asymmetrical pulse generator may best be explained by making certain assumptions. It will be assumed that upon application of the supply voltage to amplifier terminal 317 that the initial charge on the capacitor 327 is zero, and that the non-inverting input at terminal 320 will be at a positive voltage above ground as a result of the aforementioned voltage divider. Since the voltage at the non-inverting terminal 320 is approximately zero, the output voltage of the pulse generator is at a high, or approximately supply voltage; that is, in this case, typically 15 volts.

The output voltage is fed back through a network comprising resistor 324, in parallel with the series combination of a diode 325 and resistor 326. Said network is in turn connected to capacitor 327 which is used to produce the primary timing. Since the output of the amplifier 316 is at supply voltage, both resistors 324 and 326 are acting essentially in parallel, and represent a relatively low resistance so as to cause the capacitor 327 to charge up in a relatively short interval; as for example, 3/10 of a second. When the voltage across the capacitor 327 approximates the voltage available at the amplifier non-inverting input terminal 320, at the instant that the voltage at the amplifier inverting input terminal 319 becomes slightly higher, the amplifier 316 suddenly switches its output. By "slightly higher," it is meant, thousandths of a volt. The output then drops to a low of approximately one volt. At that time, the voltage across the positive or non-inverting input terminal 320 drops to a low value of approximately ½ volt. The voltage across the capacitor 327 is still approximately one-half the supply voltage, and it cannot change suddenly. Under these conditions, the capacitor 327 then starts to discharge its voltage through resistor 324 only, and since the resistor 324 has a relatively high value of resistance, the length of time that it takes the capacitor 327 to discharge is determined solely by the size of the capacitor 327 and the value of the resistor 324. When the capacitor 327 discharges to the point that the voltage at the inverting input terminal 319 becomes slightly lower than that appearing at the non-inverting terminal 320, the amplifier 316 suddenly alternates state, and its output goes to a high. The aforegoing represents essentially one cycle in the operation of the asymmetrical pulse generator 342.

If the high at the junction point 348 represents an "on," and the low represents an "off," the length of time that the pulse is "on," is determined by the value of the capacitor 327 and the resistance of the combination of resistors 324 and 326 operating in parallel. This value of resistance will be somewhat smaller than the individual value of either of the resistors 324 or 326, and it is determined by Ohms Law. Accordingly, it will be seen that the "on" time is essentially controlled by both of the resistors 324 and 326 and the capacitor 327, and that the "off" time is determined by only one resistor; namely, the resistor 324. The values of the resistors 324 and 326 and the capacitor 327 are thus selected to give the desired times to provide complete control of the length of time that the pulse is "on" and the length of time that the pulse is "off."

The reference numeral 343 in FIG. 12 generally designates the firing solenoid driver for operating the water cannon firing solenoid 146. The firing solenoid driver 343 is basically an amplifier combined with a logic level shifter. The amplifier portion of the firing solenoid driver 343 comprises a pair of transistors 333 and 335, and a resistor 334. The last mentioned devices act as controllable switches, so that if there is a current applied to the base 349 of transistor 333 that is of a sufficient magnitude to energize said devices as switches, the devices approach a high conduction state. As high conduction devices, they will then allow a large current flow from the power supply through the trigger controlled line 350 and through the water cannon firing solenoid 146, and to ground. Accordingly, the transistors 333 and 335 and the resistor 334 are completing the circuit so that when there is sufficient current flow into the base 349 of transistor 333 to cause the transistors 333 and 335 to go to a higher conduction state, they apply essentially full power to the water cannon firing solenoid 146.

The level shifter comprises a 6-volt zener diode 331. The resistors 330 and 332 comprise a voltage divider, and the values of these resistors are determined in such a way that when the output of the pulse generator 342 is "on," the magnitude of the voltage at the junction point 348 is on the order of 15 volts, sufficient current is supplied to base 349 to turn on the driver amplifier. The function of the diode 331 is to prevent the flow of any current into the base 349 of the transistor 333 and through the resistor 332, when the voltage output of the pulse generator is less than 6 volts. Accordingly, when the voltage across the junction point 348 drops to less than 6 volts, there will be no current flow into the base 349 of the transistor 333, and the driver amplifier will be off. A typical voltage at the junction point 348 in the "off" state is on the order of 1 volt, so that the zener diode 331 assures that there is no flow of current to the transistor base 349. When the pulse generator 342 is "on," that voltage will be approximately 15 volts.

When the output at the junction point 348 is "on," there is sufficient voltage to break down the zener diode 331 and cause the current through the resistor 330 to be sufficient to energize the driver amplifier comprising the transistors 333 and 335, so that when the output voltage is at 15 volts, the firing solenoid driver 343 is "on." When the voltage is below 6, the driver amplifier is turned "off," which in turn de-energizes the water cannon firing solenoid 146. The diode designated by the reference numeral 336 is a zener diode that is designed primarily to prevent the inductive voltage generated by turning off the firing solenoid valve from damaging the transistors 333 and 335 due to excessive voltage.

The reference numeral 341 in FIG. 12 generally designates the additive injection solenoid driver, and the circuit configuration is essentially identical with that of the firing solenoid driver 343. The actual values may change slightly because of the differing current requirements of the different solenoids. The injection driver 341 operates in an identical fashion to the operation of the firing solenoid driver 343, but it is not controlled by the asymmetrical pulse generator 342. Accordingly, the water cannon additive injection solenoid 293 is energized upon application or closure of either one of the trigger switches 65, and is de-energized by de-activation of the trigger switches 65.

The water cannon firing solenoid is generally designated by the numeral 146 in FIG. 12A, and it is basically a two-coil solenoid. One of the coils is designated by the reference numeral 291 and it may be termed a "pull-in" coil. The other coil is designated by the reference numeral 292 and may be termed a "holding" coil. The numeral 351 designates a switch which is normally closed when the solenoid 146 is inoperative, but which is opened when the solenoid is energized and the solenoid plunger 220 (FIG. 6) is moved to a fully extended position. The reference numeral 352 designates a capacitor which reduces the contact arching upon opening of the switch 351.

The pull-in coil 291 is a high current, high force level generating coil which functions to produce the force necessary for actuating solenoid 146. After the solenoid plunger 220 has reached its energized or fully extended position, the necessity for the high force disappears, and the pull-in coil 291 is automatically disconnected. The disconnection of the pull-in coil 291 is effected by the opening of the switch 351. The switch 351 is opened by a mechanical linkage between the solenoid plunger 220 and switch 351, which is operable when the plunger 220 has reached the 80% point in its extended travel. When the pull-in coil 291 is disconnected, the holding coil 292 provides a sufficient holding force to cause the solenoid plunger 220 to hold in its extended or energized position. When the power is removed from the solenoid 146, the solenoid plunger 220 drops back to its inoperative position, and the switch 351 is closed automatically. The solenoid 146 is then ready to repeat the aforedescribed cycle.

The control circuitry for the additive pump drive motor 279 is illustrated in FIG. 12A. The additive pump drive motor 279 is a shunt wound DC motor. The speed of the motor 279 is adjustable, and such adjustment is accomplished by controlling the field current. The field current is controlled by the use of a pair of fixed resistors 341 and 342 connected in parallel, and a variable resistor 353. The speed of the drive motor 379 is adjusted to create the desired additive injection pressure.

Upon closure of the arm switch 289, power is supplied to a relay which comprises a coil 338 and contacts 337. The application of the power causes the relay to close, thereby connecting the battery 273 to the additive drive pump motor 279 through a thermal circuit breaker 340, and a thermal current limiting detector 339. The thermal circuit breaker 340 functions as a switch that opens and breaks the circuit is the event of excessive motor current. When the relay is closed, voltage is applied to the motor armature and the fields, simultaneously. The motor 279 will then operate and rotate at a speed determined by the load and the setting of the variable resistor 353, which determines the field current. Accordingly, the basic operation is such that the motor 279 operates at all times that the power arm switch 289 is "on." The water cannon additive injection solenoid 293 is only operated on closure of either of the triggers 65.

When either one of the triggers 65 is closed, the trigger timer circuit 340 starts to operate. At the same time, the assymmetrical pulse generator 342 operates and it commences generating an "on" pulse. The "on" pulse is applied to the firing solenoid driver circuit 343 which in turn operates the water cannon solenoid 146. After approximately 3/10 of a second, the output of the asymmetrical pulse generator 342 drops to a low and stays low for approximately 0.7 to 1.0 second duration. When said output drops, the firing driver solenoid 343 cuts off, thereby deactivating the water cannon firing solenoid 146. After 0.7 to 1.0 second duration of "off," pulse generator 342, due to its timing, will revert back to an "on" condition. The trigger timer circuit 340 is still continuing to time at this point and does not take any action. A second "on" period then occurs which turns the firing solenoid driver 343, and consequently the water cannon firing solenoid 146, to an "on" condition. The last mentioned condition persists again for approximately 3/10 of a second, at which time the asymmetrical pulse generator 342 reverts to an "off" condition, thereby turning off the firing driver solenoid 343 and the water cannon firing solenoid 146. The firing solenoid driver 343 stays "off" for another period of approximately 0.7 to 1.0 second duration, and then turns back "on" due to the pulse generator 342, and it stays "on" again for approximately 3/10 of a second. At the end of the 3/10 of a second interval, the firing solenoid driver 343 turns "off" again, thereby deactivating the water cannon firing solenoid 146. At this point, there has been accomplished three, 3/10 of a second bursts of the coherent or discrete non-divergent water cannon, or firing of water projectiles, each separated by approximately 0.7 to 1.0 second duration.

After the third burst, the trigger timer circuit 340 is operating in such a fashion, that it becomes energized and it causes the supply voltage applied to the asymmetrical pulse generator 342 and injection solenoid driver 341 to drop to approximately one-third of the voltage, or approximately 5 volts. The asymmetrical pulse generator circuit 342 continues to function. However, the output at junction point 348 is now operating between approximately 0 volts and 5 volts, and since 5 volts is insufficient to operate the firing solenoid driver 343, or the injection solenoid driver 341, both of these elements remain "off," thereby causing the water cannon firing solenoid 146 and the water additive injection solenoid 293 to be inoperative. So long as either one of the triggers 65 is closed, the voltage applied to the pulse generator 342 will remain at approximately 5 volts. Under such condition, nothing will happen. Although the pulse generator 342 will be generating pulses, neither of the solenoids 146 or 293 will be activated. When both of the triggers 65 are released, the silicon controlled rectifier 298 in the trigger timer circuit 340 is reset to a nonconducting state, and this circuit is ready for reapplication of the triggers 65. When either one of the triggers 65 is closed again, the trigger timer circuit 340 starts its timing function, the pulse generator 342 starts its timing cycle, and the whole operation continues as described hereinabove.

The following are typical values of the illustrative embodiment:

Capacitor 296: 2 microfarads
Capacitor 301: .68 microfarads
Capacitor 327: .68 microfarads
Diode 295: IN 4744
Diode 299: IN 4148
Diode 307: IN 5365A
Diode (SCR) 298: 2N 2323
Diode 312: IN 4735
Diode 325: IN 4148
Diode 336: IN 5365
Diode 331: IN 4735
Operational amplifier: PA 741
Resistor 304: 270 ohms
Resistor 297: 50 ohms
Resistor 300: 4.7 Meg. ohms
Resistor 303: 100 ohms
Resistor 309: 150 ohms
Resistor 311: 1K ohms
Resistor 313: 470 ohms
Resistor 321: 51K ohms
Resistor 322: 51K ohms
Resistor 323: 43K ohms
Resistor 324: 820K ohms
Resistor 326: 200K ohms
Resistor 330: 370 ohms
Resistor 332: 1K ohms
Resistor 334: 150 ohms
Transistor 302: 2N 2646
Transistor 308: 2N 3771
Transistor 310: 2N 2270
Transistor 333: 2N 2270
Transistor 335: 2N 3771

While it will be apparent that the preferred embodiment of the invention herein disclosed is well calculated to fulfill the objects above stated, it will be appreciated that the invention is susceptible to modification, variation and change.

What is claimed is:

1. In a water cannon for use in controlling large crowds of unruly people, the combination comprising:

A. a cannon body having a discharge nozzle means;

B. a pressurized water supply means connected to said cannon body for supplying water under pressure thereto;

C. a main stage flow control valve means for controlling the discharge of discrete water projectiles in a pulsing fashion from said nozzle means; said main stage flow control valve means includes:

1. a valve plunger axially disposed in said cannon body;
2. a floating valve seat mounted in said cannon body on which said valve plunger seats when the cannon is inoperative; and
3. means for normally biasing the valve plunger into seating engagement with said valve seat; said means for normally biasing the valve plunger includes:
   a. spring means; and
   b. a piston means connected to said valve plunger for moving the valve plunger into seating engagement with said valve seat when water under pressure is exerted against the piston;

D. means for controlling said flow control valve means in a pulsing manner to discharge the water cannon in an on-off fashion; said means for controlling said flow control valve means includes:

1. a pilot valve means for controlling the water pressure exerted against said piston;
2. a solenoid means for operating said pilot valve means; and
3. an electronic control means for operating said solenoid means in a pulsing manner.

2. A water cannon as defined in claim 1, wherein said pressurized water supply means includes:

a. a pump for supplying water under pressure to said cannon; and b. an accumulator means for providing supplemental water to the cannon when the demand exceeds the flow available from the pump during the discharge of a water projectile.

3. A water cannon as defined in claim 1, wherein said pilot valve means includes:

a. a poppet valve means operated in one direction by a spring means and in another direction by said solenoid means; and, b. a compliment spring means interconnected between said poppet valve means and said solenoid means to insure seating of said poppet valve before the completion of operation of said solenoid means.

4. A water cannon as defined in claim 3, wherein said solenoid means includes:

a. a solenoid plunger movable between an inoperative position and an extended operative position; and, b. two separate coils, with one coil functioning as a pull-in coil to initiate movement of the poppet valve load and which is automatically disconnected when the solenoid plunger has reached its extended position, and a holding coil to hold the solenoid plunger in its extended position.

5. A water cannon as defined in claim 2, including:

a. an additive reservoir;

b. a fluid circuit means interconnecting said additive reservoir and the intake end of said pump for supplying water under pressure to said cannon; and, c. an additive pump for drawing additive from said reservoir and supplying additive under pressure to said fluid circuit means.

6. A water cannon as defined in claim 5, including:

a. a solenoid operated injection valve means for controlling the selective injection of additive from said fluid circuit into said intake end of said water pump.

7. A water cannon as defined in claim 6, wherein said electronic control means includes:

a. a power source for supply voltage;

b. a trigger time means;

c. a trigger means for connecting said trigger timer means to said power source for activating said trigger timer means;

d. an asymmetrical pulse generator means controlled by said trigger timer means, and being operable to generate a predetermined sequence of on-off pulses of equal time intervals upon operation of the trigger means; and, e. a firing solenoid driver means operated by said on-off pulses for selectively energizing said solenoid means for operating said pilot valve means for a predetermined sequence of time intervals.

8. A water cannon as defined in claim 7, including:

a. an injection solenoid driver means controlled by said trigger means for energizing the solenoid for said injection valve means.

9. A water cannon as defined in claim 7, wherein:

a. said asymmetrical pulse generator means comprises a comparator means.

10. A water cannon as defined in claim 7, wherein:

a. said trigger timer means, when activated by the trigger means, measures a predetermined period of time during which full supply voltage is applied to the pulse generator and a pulse is generated sufficient to drive the firing solenoid driver means after which the supply voltage to the pulse generator is reduced and the output voltage of the pulse generator is insufficient to drive the firing solenoid driver means.

* * * * *